US005262287A

United States Patent [19]

Deguchi et al.

[11] Patent Number: 5,262,287

[45] Date of Patent: Nov. 16, 1993

[54] SILVER HALIDE COLOR REVERSAL PHOTOGRAPHIC MATERIAL CAPABLE OF PROVIDING INTERIMAGE EFFECT

[75] Inventors: Naoyasu Deguchi; Junichi Tamano, both of Kanagawa, Japan

[73] Assignee: Fuji Photo Film Co., Ltd., Kanagawa, Japan

[21] Appl. No.: 646,972

[22] Filed: Jan. 28, 1991

[30] Foreign Application Priority Data

Jan. 31, 1990 [JP] Japan ..... 2-21126

[51] Int. Cl.[5] ..... G03C 7/333; G03C 1/46; G03C 1/485

[52] U.S. Cl. ..... 430/504; 430/362; 430/379; 430/407; 430/505; 430/506; 430/544; 430/567

[58] Field of Search ..... 430/362, 504, 505, 506, 430/379, 407, 218, 219, 544, 567

[56] References Cited

U.S. PATENT DOCUMENTS

| | | | |
|---|---|---|---|
| 3,536,486 | 10/1970 | Beavers | 430/351 |
| 4,082,553 | 4/1978 | Groet | 430/504 |
| 4,248,962 | 2/1981 | Lau | 430/382 |
| 4,554,245 | 11/1985 | Hayashi et al. | 430/505 |
| 4,720,451 | 1/1988 | Shuto et al. | 430/379 |
| 4,729,943 | 3/1988 | Platt et al. | 430/379 |
| 4,760,016 | 7/1988 | Hirabayashi et al. | 430/505 |
| 4,788,132 | 11/1988 | Deguchi et al. | 430/379 |
| 4,806,459 | 2/1989 | Makino et al. | 430/504 |
| 4,830,954 | 5/1989 | Matejec | 430/505 |
| 5,051,345 | 9/1991 | Haraga et al. | 430/505 |

FOREIGN PATENT DOCUMENTS

| | | | |
|---|---|---|---|
| 0108250 | 5/1984 | European Pat. Off. . | |
| 0119851 | 9/1984 | European Pat. Off. | 430/505 |
| 1519993 | 8/1978 | United Kingdom | 430/505 |

*Primary Examiner*—Lee C. Wright

*Attorney, Agent, or Firm*—Sughrue, Mion, Zinn Macpeak & Seas

[57] ABSTRACT

A silver halide color reversal photographic material comprising a support having thereon at least one cyan coupler-containing red-sensitive silver halide emulsion layer, at least one magenta coupler-containing green-sensitive silver halide emulsion layer, and at least one yellow coupler-containing blue-sensitive silver halide emulsion layer, wherein the total light-sensitive silver halide grains in the photographic material have an average silver iodide content of 5.5 mol % or less, and said at least one of light-sensitive silver halide emulsion layers and a substantially light-insensitive hydrophilic colloidal layer adjacent thereto comprises means for producing an interimage effect, said interimage effect satisfying at least one of relationships (a) and (b):

(a)

$$0.20 \leqq \Delta\log E(R_{0.5}) \leqq 0.40,$$

$$0 \leqq \Delta\log E(R_{1.5}) \leqq 0.07,$$

and $$0.18 \leqq \Delta\log E(R_{0.5}) - \Delta\log E(R_{1.5}) \leqq 0.35$$

(b)

$$0.25 \leqq \Delta\log E(G_{0.5}) \leqq 0.45,$$

$$0 \leqq \Delta\log E(G_{1.5}) \leqq 0.15,$$

and $$0.23 \leqq \Delta\log E(G_{0.5}) - \Delta\log E(G_{1.5}) \leqq 0.35$$

wherein $\Delta\log E(R_{0.5})$ and $\Delta\log E(R_{1.5})$ each represents an interimage effect on a red-sensitive silver halide emulsion layer at a cyan density of 0.5 and 1.5, respectively; and $\Delta\log E(G_{0.5})$ and $\Delta\log E(G_{1.5})$ each represents an interimage effect on a green-sensitive silver halide emulsion layer at a magenta density of 0.5 and 1.5, respectively. The photographic material exhibits excellent color and tone reproducibility, i.e., high saturation and excellent description of a shade.

18 Claims, 1 Drawing Sheet

SILVER HALIDE COLOR REVERSAL PHOTOGRAPHIC MATERIAL CAPABLE OF PROVIDING INTERIMAGE EFFECT

FIELD OF THE INVENTION

This invention relates to a silver halide color reversal photographic material having improved image quality. More particularly, it relates to a silver halide color reversal photographic material having improved tone reproducibility and improved color reproducibility.

BACKGROUND OF THE INVENTION

In recent years, there has been an increasing demand for color photographic materials having high image quality. Satisfying the demand requires multi-faceted and synthetic improvements of photographic characteristics embracing image structures such as sharpness and graininess, color reproducibility, tone reproducibility, and the like.

With respect to color reproducibility, there is a need not only to reproduce a hue with good fidelity but to reproduce a bright tone and more accurate. In order to achieve brighter color reproduction, so-called masking or an interimage effect has been utilized as disclosed in U.S. Pat. No. 2,521,908.

Details of an interimage effect are described, e.g., Hanson, et al., *Journal of the Optical Society of America*, Vol. 42, pp. 663–669 and A. Thiels, *Zeitshrift fur Wissenschaftliche Photographie, Photoohysique und Photochemie*, Vol. 47, pp. 106–118 and 246–255.

U.S. Pat. No. 3,536,486 discloses a method for obtaining an interimage effect by introducing diffusible 4-thiazolin-2-thione into an exposed color reversal element, and U.S. Pat. No. 3,536,487 discloses a method for obtaining an interimage effect by introducing diffusible 4-thiazolin-2-thion into an unexposed color reversal photographic element.

JP-B-48-34169 (the term "JP-B" as used herein means an "examined published Japanese patent application") describes that a marked interimage effect can be obtained by reducing silver halide to silver by development in the presence of an N-substituted-4-thiazolin-2-thion compound.

*Research Disclosure* No. 13116 (March, 1975) describes that a colloidal silver-containing layer is provided between a cyan layer and a magenta layer of a color reversal photographic element to obtain an interimage effect.

U.S. Pat. No. 4,082,553 discloses a method for obtaining an interimage effect in a color reversal photographic material having such a layer structure which permits migration of iodide ions during development wherein latent image-forming silver haloiodide grains are incorporated into one of the constituting layers, and latent image-forming silver halide grains and silver halide grains whose surface have been fogged so as to be developable irrespective of imagewise exposure are incorporated into another constituting layer In addition, JP-A-62-11854 (the term "JP-A" as used herein means an "unexamined published Japanese patent application") discloses an improvement in interimage effect of a color reversal photographic material which is brought about by addition of a 5-mercapto-1,3,4-thiadiazole compound.

Thus, color reproducibility and, in particular, saturation can be improved by enhancing an interimage effect. However, production of an interimage effect in excess results in insufficient reproduction of a delicate shade of color possessed by an original and reproduction of shade. Such a loss of gradation is considered to be due to absence or flattening of gradation of a complementary color in the image area where an original color should be reproduced, and this is a great evil of an interimage effect.

For example, when a red color is photographed, gradation of a cyan color is lost or flattened by a great interimage effect so that a bright red color is reproduced but, in turn, a delicate shade in the shade portion cannot be reproduced (so-called gradation loss of red). When a yellow color is photographed, cyan and magenta densities become low and flattened, making reproduction of bright yellow possible, but failing to reproduce a tone of the shade (gradation loss of yellow).

On the other hand, in the area where a bright red color should be reproduced, if a complementary color, i.e., cyan, becomes too hard, reproduction of a shade can be improved, but saturation is unfavorably reduced.

Thus, the exposure range where a complementary color is incorporated and the amount of the incorporated complementary color impact significantly on saturation and description of shades.

The above-described exposure range where a complementary color is incorporated and the amount of the incorporated complementary color can be adjusted to some extent by controlling interimage effect, spectral sensitivity distribution, and the like.

However, conventional techniques which have been proposed to date have found great difficulty in achieving strict control of these factors. Moreover, whether a given exposure range where a complementary color is incorporated and the amount thereof would be the most suitable for desired saturation and description of shades has not yet been determined.

SUMMARY OF THE INVENTION

An object of the present invention is to provide a silver halide color reversal photographic material which has high chroma and saturation in low to middle density areas without impairing color reproducibility and which is excellent in reproducibility of delicate shades in a high density area.

The above and other objects and advantages of the present invention are accomplished by a silver halide color reversal photographic material comprising a support having thereon at least one cyan coupler-containing red-sensitive silver halide emulsion layer, at least one magenta coupler-containing green-sensitive silver halide emulsion layer, and at least one yellow coupler-containing blue-sensitive silver halide emulsion layer, wherein the total light-sensitive silver halide grains in the photographic material have an average silver iodide content of about 5.5 mol % or less, and at least one of said light-sensitive silver halide emulsion layers and/or at least one substantially light-insensitive hydrophilic colloidal layer adjacent thereto comprises means for producing an interimage effect, said interimage effect satisfying at least one of relationships (a) and (b):

(a)

$$0.20 \leqq \Delta \log E(R_{0.5}) \leqq 0.40,$$

$$0 \leqq \Delta \log E(R_{1.5}) \leqq 0.07,$$

and $$0.18 \leqq \Delta\log E(R_{0.5}) - \Delta\log E(R_{1.5}) \leqq 0.35$$

(b)

$$0.25 \leqq \Delta\log E(G_{0.5}) \leqq 0.45,$$

$$0 \leqq \Delta\log E(G_{1.5}) - 0.15,$$

and $$0.23 \leqq \Delta\log E(G_{0.5}) \leqq \Delta\log E(G_{1.5}) \leqq 0.35$$

wherein $\Delta\log E(R_{0.5})$ and $\Delta\log E(R_{1.5})$ each represent an interimage effect on a red-sensitive silver halide emulsion layer at a cyan density of 0.5 and 1.5, respectively; and $\Delta\log E(G_{0.5})$ and $\Delta\log E(G_{1.5})$ each represent an interimage effect on a green-sensitive silver halide emulsion layer at a magenta density of 0.5 and 1.5, respectively.

DETAILED DESCRIPTION OF THE INVENTION

Figure 1:
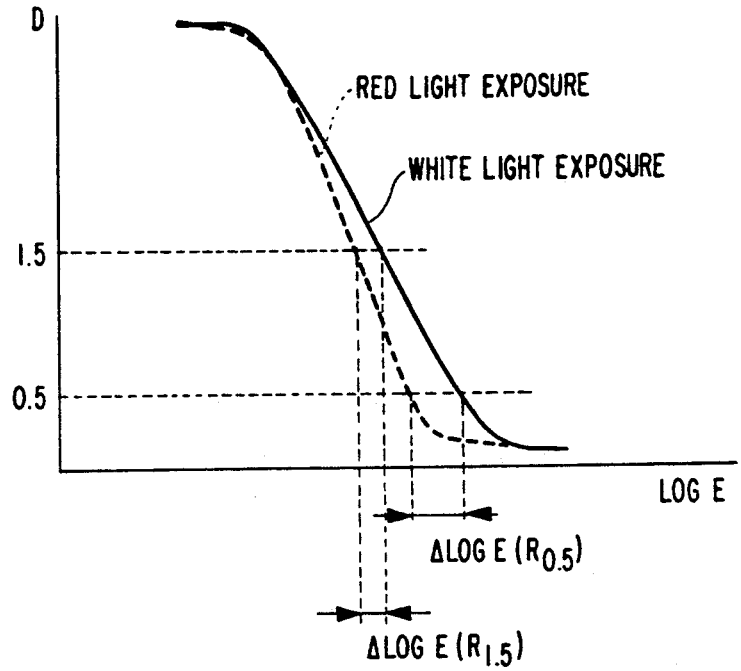
FIG. 1 shows an HD curve of the light-sensitive material of the present invention exposed to white light or red light and developed.

"Means for producing an interimage effect" which can be used in the present invention are described below with respect to various embodiments which can be employed to achieve the above-mentioned relationships (a) and (b). These include the followings.

(1) At least one pair of light-sensitive silver halide emulsion layers differing in color sensitivity have a difference of at least 1 mol % in average silver iodide content.

(2) The light-sensitive material contains a compound capable of releasing a development inhibitor or a precursor thereof on oxidation-reduction reaction with an oxidation product of a developing agent.

(3) The light-sensitive material contains a compound represented by formula (III) hereinafter described.

(4) The light-sensitive material contains at least one of a diffusible 4-thiazolin-2-thion compound and an N-substituted-4-thiazolin-2-thion compound.

(5) The light-sensitive material contains a silver halide emulsion comprising surface-fogged silver halide grains.

(6) The light-sensitive material contains a silver halide emulsion comprising internally-fogged silver halide grains.

(7) The light-sensitive material contains colloidal silver in a layer other than a yellow filter layer or an antihalation layer.

(8) The light-sensitive material contains an electron donor-releasing coupler.

In a preferred embodiment of the present invention, an interimage effect can be efficiently exercised by satisfying the condition specified in means (1), and incorporating at least one of the substances specified in means (2) to (8), and preferably at least one of the substances of means (2), (3), (5) and (6), into at least one of the light-sensitive silver halide emulsion layers and substantially light-insensitive hydrophilic colloidal layers.

It is preferable that both the emulsion layer and the light-insensitive hydrophilic colloidal layer be provided with means for producing an interimage effect. In this case, means other than (1) are preferably provided to the above-described emulsion layers and the light-insensitive layers adjacent thereto, and more preferably provided to the light insensitive layer adjacent to the low-speed silver halide emulsion layer among layers having the same color sensitivity.

The effects of the present invention can also be obtained where the interimage effect-producing means are provided only to the light-insensitive layers.

In order to satisfy the relationship (a), means (2) to (8) is preferably applied to the red-sensitive layer and/or a light-insensitive hydrophilic colloid layer adjacent thereto. On the other hand, in order to satisfy the relationship (b), means (2) to (8) is preferably applied to the green-sensitive layer and/or a light-insensitive hydrophilic layer adjacent thereto.

The degree of an interimage effect can be controlled in a strict manner by using the above-described means in the manner described.

The interimage effect thus produced can be determined according to the following method.

(i) Cyan, Magenta and Yellow Densities on Exposure to White Light (Red Light+Green Light+Blue Light)

Figure 2:
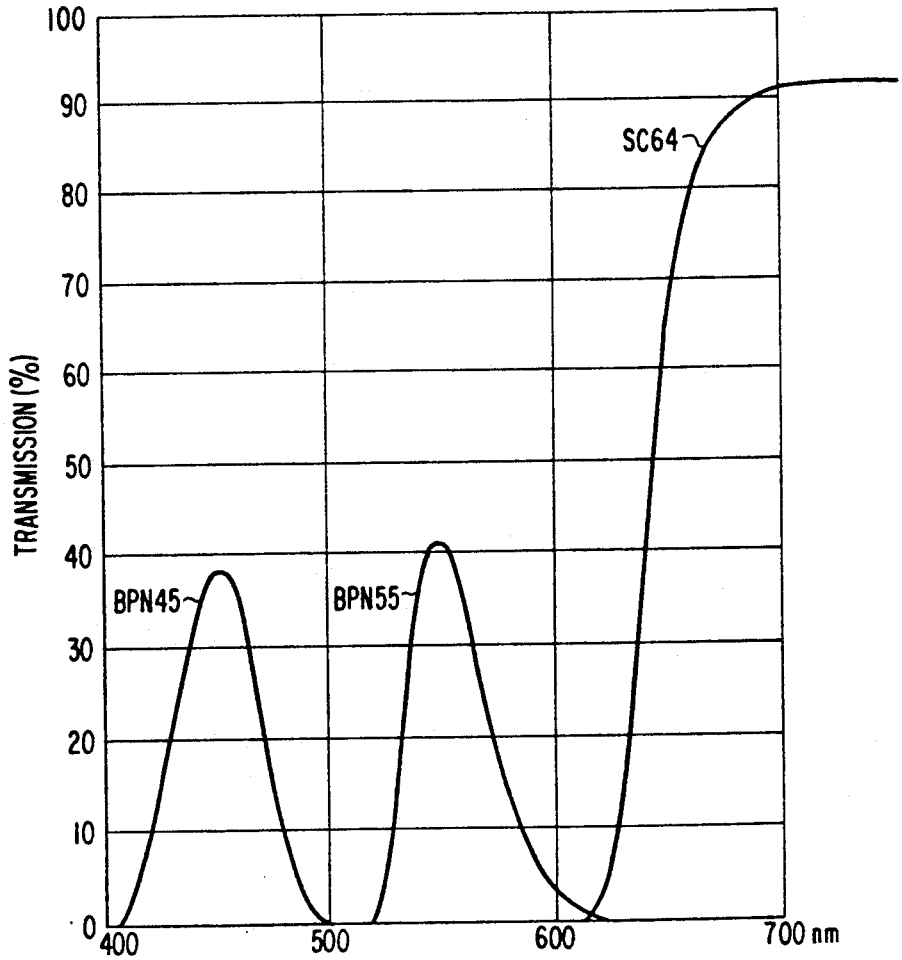
FIG. 2 shows spectral transmittance of filters used in the present invention.

A sample is exposed through a continuous wedge to light through a filter "Fuji Filter SC-64" (produced by Fuji Photo Film Co., Ltd.) for 1/10 of a second using a tungsten light source to which a color conversion filter of 4800° K. is fitted (red light exposure). Then, the same sample is exposed to light in the same manner, except for using a filter "BPN-55" (produced by Fuji Photo Film Co., Ltd.) in place of "SC-64" (green light exposure). Finally, the same sample is exposed to light in the same manner, except for using "BPN-45" (produced by Fuji Photo Film Co., Ltd.) as a filter (blue light exposure). Spectral transmittance of these filters are shown in FIG. 2.

Exposure to white light is thus achieved by exposing a sample three times each using a filter, SC-64, BPN-55, or BPN-45.

The exposed sample is subjected to color reversal development in a prescribed manner, and cyan, magenta and yellow densities are measured When the color balance of the developed sample is not gray, the exposure amounts in the above-described red light exposure, green light exposure and blue light exposure are adjusted so that the color balance of the developed sample becomes gray.

The measured densities of cyan, magenta and yellow are converted to analytical spectral densities by the method described in James, *The Theory of the Photographic Process*, p. 525 to prepare HD curves of cyan, magenta and yellow.

(ii) Cyan Density on Exposure to Red Light

A sample is exposed to red light under the same conditions as used for red light exposure in the white light exposure above and subjected to color reversal development in the prescribed manner. The cyan, magenta, and yellow densities are measured, and the measured densities are converted to analytical spectral densities in the same manner as in (i) above to prepare an HD curve for cyan.

(iii) Magenta Density on Green Light Exposure

A sample is exposed to green light under the same conditions as used for green light exposure in the white light exposure above and subjected to color reversal development in the prescribed manner. The cyan, magenta, and yellow densities are measured, and the measured densities are converted to analytical spectral densities in the same manner as in (i) above to prepare an HD curve for magenta.

(iv) Determination of $\Delta\log E(R_{0.5})$ and $\Delta\log E(R_{1.5})$

The difference between the cyan HD curves prepared in (i) and (ii) above in exposure amount at a cyan density of 0.5 or 1.5 was taken as $\Delta\log E(R_{0.5})$ or $\Delta\log E(R_{1.5})$, respectively (see FIG. 1).

(v) Determination of $\Delta\log E(G_{0.5})$ and $\Delta\log E(G_{1.5})$

The difference between the magenta HD curves prepared in (i) and (ii) above in exposure amount at a magenta density of 0.5 or 1.5 was taken as $\Delta\log E(G_{0.5})$ or $\Delta\log E(G_{1.5})$, respectively.

The interimage effect according to the present invention satisfies at least one of relationships (a) and (b):

(a)

$$0.20 \leqq \Delta\log E(R_{0.5}) \leqq 0.40,$$

$$0 \leqq \Delta\log E(R_{1.5}) \leqq 0.07,$$

and $$0.18 \leqq \Delta\log E(R_{0.5}) - \Delta\log E(R_{1.5}) \leqq 0.35$$

(b)

$$0.25 \leqq \Delta\log E(G_{0.5}) \leqq 0.45,$$

$$0 \leqq \Delta\log E(G_{1.5}) \leqq 0.15,$$

and $$0.23 \leqq \Delta\log E(G_{0.5}) - \Delta\log E(G_{1.5}) \leqq 0.35$$

It is preferable that an interimage effect exercised on a red-sensitive emulsion layer satisfies relationship (a) and that an interimage effect exercised on a green-sensitive emulsion layer satisfies relationship (b). The interimage effect on a red-sensitive emulsion layer more preferably satisfies the following relationship (a'):

(a')

$$0.20 \leqq \Delta\log E(R_{0.5}) \leqq 0.38,$$

$$0.01 \leqq \Delta\log E(R_{1.5}) \leqq 0.07,$$

and $$0.19 \leqq \Delta\log E(R_{0.5}) - \Delta\log E(R_{1.5}) \leqq 0.34$$

The interimage effect on a green-sensitive emulsion layer more preferably satisfies the following relationship (b'):

(b')

$$0.26 \leqq \Delta\log E(G_{0.5}) \leqq 0.44,$$

$$0.01 \leqq \Delta\log E(G_{1.5}) \leqq 0.15,$$

and $$0.24 \leqq \Delta\log E(G_{0.5}) - \Delta\log E(G_{1.5}) \leqq 0.34$$

The total light-sensitive silver halide grains in the light-sensitive material according to the present invention have an average silver iodide content of about 5.5 mol % or less, preferably 5.2 mol % or less, and more preferably between 5.0 mol % and 1.7 mol %.

The reason for the comparative low average silver iodide content is that if the content is large the interimage effect produced does not fall within the above-specified relationships even where interimage effect-producing means (1) and at least one of (2) to (8) are provided.

In means (2), the at least one pair of light-sensitive silver halide emulsion layers may be any combination selected from three color sensitive emulsion layers. The difference of the average silver iodide is preferably at most 6 mol %, and preferably from 1 to 5 mol %.

The redox compound capable of releasing a development inhibitor or a precursor thereof on oxidation-reduction reaction with an oxidation product of a developing agent as described in means (2) is explained below.

The compound is preferably those which are represented by formula (II) or (IV):

$$A\text{—}(Time)_t\text{—}X \qquad (II)$$

wherein A represents an oxidation-reduction nucleus, i.e., an atomic group which allows —$Time_tX$ to be released therefrom upon being oxidized during development processing; Time represents a timing group linked to A through a sulfur atom, a nitrogen atom or an oxygen atom; t represents 0 or 1; and X represents a development inhibitor moiety;

$$R_1\text{—}\underset{\underset{A_1}{|}}{N}\text{—}\underset{\underset{A_2}{|}}{N}\text{—}G_1\text{—}(Time)_t\text{—}PUG \qquad (IV)$$

wherein $R_1$ represents an aliphatic or aromatic group; $G_1$ represents $$\text{—}\overset{\overset{O}{\|}}{C}\text{—},$$

$$\text{—}SO_2\text{—},\ \text{—}SO\text{—},$$

$$\text{—}\underset{\underset{R_2}{|}}{\overset{\overset{O}{\|}}{P}}\text{—},$$

or an iminomethylene group; $R_2$ represents an alkoxy group, an aryloxy group, or an amino group; $A_1$ and $A_2$ both represent a hydrogen atom, or one of them represents a hydrogen atom with the other representing a substituted or unsubstituted alkylsulfonyl group, a substituted or unsubstituted arylsulfonyl group, or a substituted or unsubstituted acyl group; Time represents a divalent linking group; t represents 0 or 1; and PUG represents a development inhibitor moiety.

In formula (II), the oxidation-reduction nucleus as represented by A includes hydroquinone, catechol, p-aminophenol, o-aminophenol, 1,2-naphthalenediol, 1,4-naphthalenediol, 1,6-naphthalenediol, 1,2-aminonaphthol, 1,4-aminonaphthol, and 1,6-aminonaphthol. The amino group in A is preferably substituted with a sulfonyl group having from 1 to 25 carbon atoms or an acyl group having from 1 to 25 carbon atoms. The sulfonyl group includes substituted or unsubstituted aliphatic or aromatic sulfonyl groups, and the acyl group includes substituted or unsubstituted aliphatic or aromatic acyl groups (the same for definitions of formula (II)). The hydroxyl group or amino group in A may be protected with a protecting group which is removable on development processing. Examples of such a protecting group include those having from 1 to 25 carbon atoms, e.g., an acyl group, an alkoxycarbonyl group, a carbamoyl group, and protecting groups described in JP-A-59-197037 and JP-A-59-201057 (corresponding to U.S. Pat. Nos. 4,629,683 and 4,518,685, respectively). The protecting group, if possible, may be connected to a substituent of A hereinafter described to form a 5-, 6- or 7-membered ring.

The oxidation-reduction nucleus as represented by A may have appropriate substituents as long as the redox ability thereof is not impaired. Such substituents include those having from 2 to 5 carbon atoms, e.g., an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, a halogen atom, an acyl group, and a carboxyl group.

—$Time_tX$ in formula (II) is a group which is released from A as $^{\theta}$—$Time_tX$ when the nucleus A undergoes cross-oxidation reaction during development and becomes an oxidized form.

"Time" is a timing group linked to A through a sulfur atom, a nitrogen atom, or an oxygen atom and includes those releasing X from the released $^{\theta}$—$Time_tX$ through one or more reaction steps. Examples of such a timing group are described, e.g., in U.S. Pat. Nos. 4,248,962 and 4,409,323, British Patent 2,096,783, U.S. Pat. No. 4,146,396, JP-B-51-146828, and JP-B-57-56837. "Time" may be a combination of two or more groups selected from those disclosed.

X in formula (II) represents a development inhibitor moiety. Suitable development inhibitors include heterocyclic compounds having a mercapto group bonded to the hetero ring thereof and heterocyclic groups capable of forming imino-silver.

Examples of such a development inhibitor are described, e.g., in C. E. K. Mees and T. H. James, *The Theory of Photographic Processes,* 3rd Ed., pp. 344–346, MacMillan (1966). More specifically, the development inhibitor includes mercaptoazoles such as mercaptotetrazoles and mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes, mercaptoaryls, triazoles, mercaptoxazoles, mercaptoxadiazoles, and mercaptothiazoles.

The development inhibitor moiety as represented by X may have a substituent (which may be further substituted) selected from, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a sulfoxy group, a phosphono group, a phosphinico group, and a phosphoric acid amido group. Preferred substituents are a nitro group, a sulfo group, a carboxyl group, a sulfamoyl group, a phosphono group, a phosphinico group, and a sulfonamido group.

Specific but non-limiting examples of the development inhibitor are described below.

1. Mercaptotetrazole Derivatives (1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotriazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-(4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(1-(α-Naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazolyl hydrochloride
(32) 1-(2-Diethylaminoethyl)-5-mercaptotetrazole
(33) 2-(5-Mercapto-1-tetrazolyl)ethyltrimethylammonium chloride
(34) 1-(3-Phenoxycarbonylphenyl)-5-mercaptotetrazole
(35) 1-(3-Maleinimidophenyl)-6-mercaptotetrazole 2. Mercaptotriazole Derivatives (1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole Derivatives (1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole 4. Mercaptopyrimidine Derivatives (1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Derivatives (1) 2-Mercaptobenzimidazole
(2) 5-Carboxyl-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthoimidazole
(8) 2-Mercapto-5-sulfobenzimidazole
(9) 1-(2-Hydroxyethyl)-2-mercaptobenzimidazole
(10) 5-Capronamido-2-mercaptobenzimidazole
(11) 5-(2-Ethylhexanoylamino)-2-mercaptobenzimidazole 6. Mercaptothiadiazole Derivatives (1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole 7. Mercaptobenzothiazole Derivatives (1) 2-Mercaptobenzothiazole
(2) 5-Nitro-2-mercaptobenzothiazole
(3) 5-Carboxyl-2-mercaptobenzothiazole
(4) 5-Sulfo-2-mercaptobenzothiazole 8. Mercaptobenzoxazole Derivatives (1) 2-Mercaptobenzoxazole
(2) 5-Nitro-2-mercaptobenzoxazole
(3) 5-Carboxyl-2-mercaptobenzoxazole
(4) 5-Sulfo-2-mercaptobenzoxazole 9. Benzotriazole Derivatives (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole Na salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole 10. Benzimidazole Derivatives (1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole 11. Indazole Derivatives (1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-Chloroindazole
(8) 3-Chloro-5-nitroindazole
(9) 3-Carboxyl-5-nitroindazole 12. Tetrazole Derivatives (1) 5-(4-Nitrophenyl)tetrazole
(2) 5-Phenyltetrazole
(3) 5-(3-Carboxyphenyl)tetrazole 13. Tetraazaindene Derivatives (1) 4-Hydroxy-6-methyl-5-nitro-1,3,3a,7-tetraazaindene
(2) 4-Mercapto-6-methyl-5-nitro-1,3,3a,7-tetraazaindene 14. Mercaptoaryl Derivatives (1) 4-Nitrothiophenol
(2) Thiophenol
(3) 2-Carboxythiophenol X may be such a compound which is converted to a compound having development inhibitory properties on release from Time and which then undergoes a chemical reaction with a developer component to be converted to a compound having substantially reduced development inhibitory properties or no development inhibitory properties. Functional groups which undergo such a chemical reaction include an ester group, a carbonyl group, an imino group, an immonium group, a Michael addition-receptor group, and an imido group. For details of the compounds represented by formula (II), reference can be made to JP-A-62-103637.

Specific examples of the compounds of formula (II) are shown below.

(II-1)
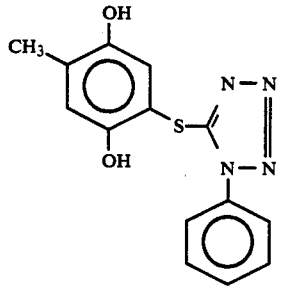
(II-2)
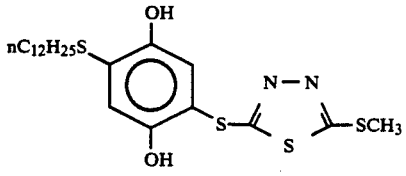
(II-3)
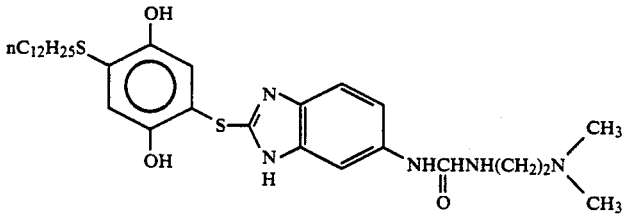
(II-4)
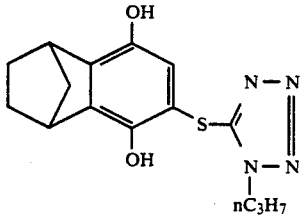
(II-5)
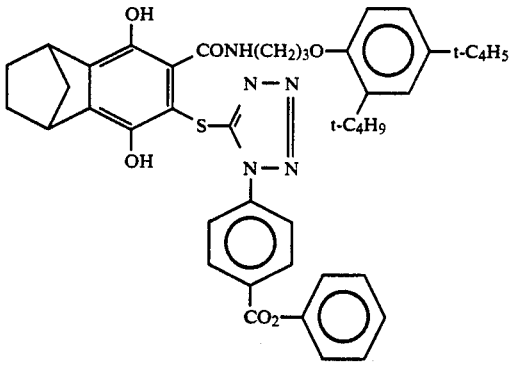
(II-6)
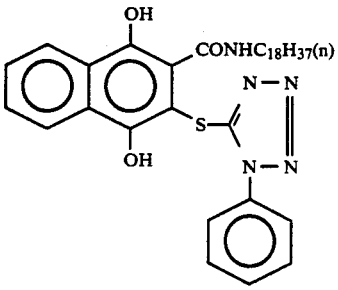

-continued
(II-7)
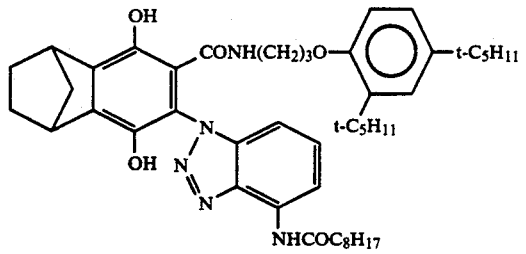
(II-8)
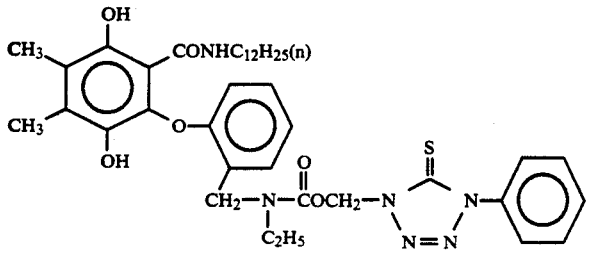
(II-9)
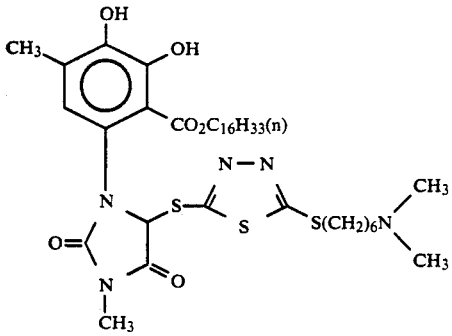
(II-10)
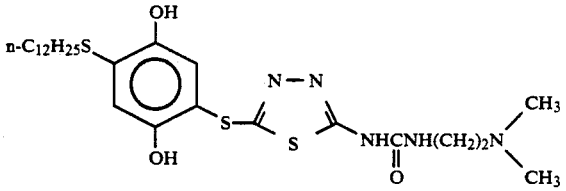
(II-11)
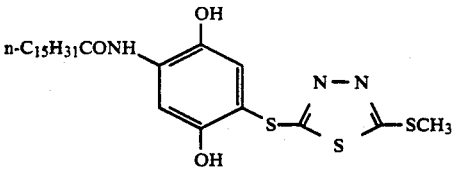
(II-12)
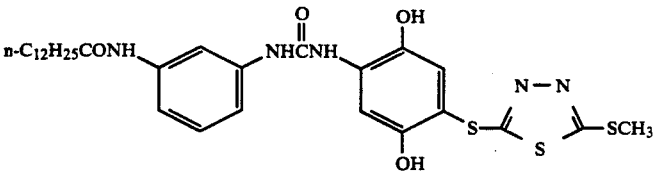
(II-13)
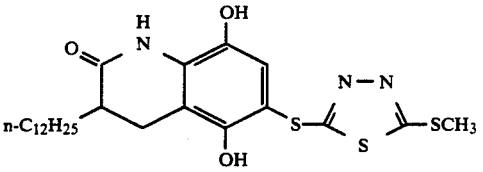

-continued (II-14)

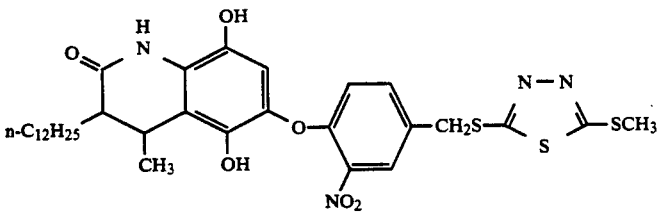

(II-15)

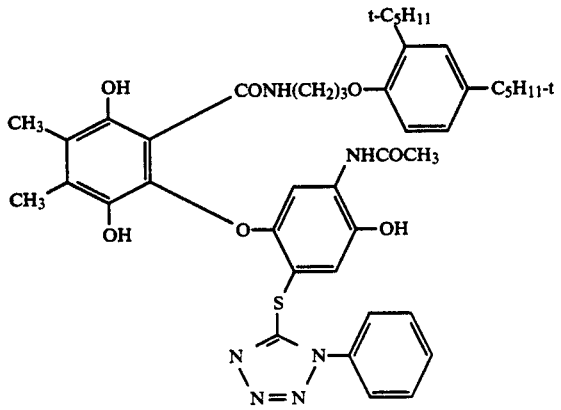

(II-16)

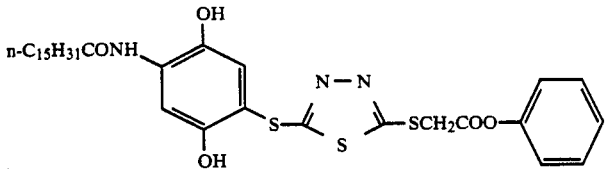

(II-17)

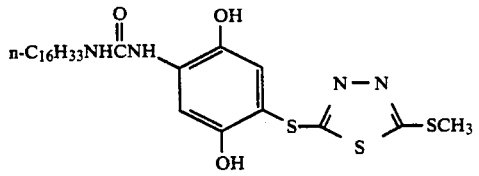

The compound of formula (II) can be incorporated into the light-sensitive material in the form of a solution prepared by dissolving the compound in a high-boiling organic oil and stirring at a high speed, or in the form of a solution in a water-soluble organic solvent, e.g., alcohols and cellosolve. It may be added in the form of a finely divided dispersion prepared by stirring in a gelatin solution.

The compound represented by formula (IV) is explained below.

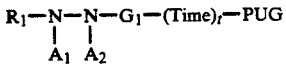

(IV)

wherein $R_1$ represents an aliphatic or aromatic group; $G_1$ represents

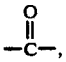

—SO—$_2$, —SO—,

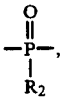

or an iminomethylene group; $R_2$ represents an alkoxy group, an aryloxy group, or an amino group; $A_1$ and $A_2$ both represent a hydrogen atom, or one of them represents a hydrogen atom with the other representing a substituted or unsubstituted alkylsulfonyl group, a substituted or unsubstituted arylsulfonyl group, or a substituted or unsubstituted acyl group; Time represents a divalent linking group; t represents 0 or 1; and PUG represents a development inhibitor moiety.

The aliphatic group as $R_1$ preferably includes those having from 1 to 30 carbon atoms, and more preferably straight chain, branched, or cyclic alkyl groups having from 1 to 20 carbon atoms. The alkyl group may have a substituent, e.g., an aryl group, an alkoxy group, a sulfoxy group, a sulfonamido group, a carbonamido group, a heterocyclic group having at least one of N, O and S atom as hetero atom, etc.

The aromatic group as $R_1$ includes a monocyclic or bicyclic aryl group or an unsaturated heterocyclic group. The unsaturated heterocyclic group (preferably a 5- to 8-membered heterocyclic group having at least one of N, O and S atom as hereto atom) may be condensed with a monocyclic or bicyclic aryl group to form a hetero aryl group. Examples of the aromatic group as $R_1$ are benzene, naphthalene, pyridine, pyrimidine, imidazole, pyrazole, quinoline, isoquinoline, benzimidazole, thiazole, and benzothiazole rings, with those containing a benzene ring being preferred.

A particularly preferred group as $R_1$ is an aryl group.

The aryl group or unsaturated heterocyclic group as $R_1$ may have a substituent typically including an alkyl group, an aralkyl group, an alkenyl group, an alkynyl group, an alkoxy group, an aryl group, a substituted amino group, a ureido group, an amino-carbonyloxy group, an alkoxycarbonylamino group, an aryloxycarbonylamino group, an aryloxy group, a sulfamoyl group, a carbamoyl group, an alkylthio group, an arylthio group, an aliphatic or aromatic sulfonyl group, an aliphatic or aromatic sulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amide group. Preferred substituents are a straight chain, branched or cyclic alkyl group (more preferably having from 1 to 20 carbon atoms), an aralkyl group (more preferably a monocyclic or bicyclic group having from 1 to 3 carbon atoms in the alkyl moiety thereof), an alkoxyl group (more preferably having from 1 to 30 carbon atoms), a substituted amino group (more preferably an amino group substituted with an alkyl group having from 1 to 30 carbon atoms), an acylamino group (more preferably having from 2 to 40 carbon atoms), a sulfonamido group (more preferably having from 1 to 40 carbon atoms), a ureido group (more preferably having from 1 to 40 carbon atoms), and a phosphoric acid amido group (more preferably having from 1 to 40 carbon atoms).

$G_1$ in formula (IV) preferably represents $$-\overset{\overset{\displaystyle O}{\|}}{C}-.$$

$A_1$ and $A_2$ each represents a hydrogen atom, an alkylsulfonyl or arylsulfonyl group having not more than 20 carbon atoms (preferably a phenylsulfonyl group or a phenylsulfonyl group which is substituted so that a sum of Hammett's $\sigma$ values may be $-0.5$ or more), or an acyl group having not more than 20 carbon atoms (preferably a benzoyl group, a benzoyl group which is substituted so that the sum or the Hammett's $\sigma$ values may be $-0.5$ or more, or a straight chain, branched or cyclic and substituted or unsubstituted aliphatic acyl group (the substituent includes a halogen atom, an ether group, a sulfonamido group, a carbonamido group, a hydroxyl group, a carboxyl group, and a sulfo group)).

$A_1$ and $A_2$ each preferably represents a hydrogen atom.

Examples of the divalent linking group as represented by Time include a group which releases a photographically useful group (PUG) on intramolecular cyclization reaction of a p-nitrophenoxy derivative as disclosed in U.S. Pat. No. 4,248,962 (corresponding to JP-A-54-145135); a group which releases PUG on intramolecular cyclization reaction subsequent to ring opening as disclosed in U.S. Pat. No. 4,310,612 (corresponding to JP-A-55-53330) and U.S. Pat. No. 4,358,252; a group which releases PUG on intramolecular cyclization reaction of a carboxyl group of a succinic monoester or an analogue thereof together with formation of an acid anhydride as disclosed in U.S. Pat. Nos. 4,330,617, 4,446,216 and 4,483,919 and JP-A-59-121328; a group which releases PUG while forming quinomonomethane or an analogue thereof through electron transfer via a double bond conjugated with an aryloxy group or a heterocyclic oxy group as disclosed in U.S. Pat. Nos. 4,409,323 and 4,421,845, *Research Disclosure*, No. 21228 (Dec., 1981), U.S. Pat. No. 4,416,977 (corresponding to JP-A-57-135944), JP-A-58-209736, and JP-A-58-209738; a group which releases PUG from a nitrogen-containing heterocyclic ring through electron transfer in the moiety having an enamine structure (release is from the $\gamma$-position of the enamine) as disclosed in U.S. Pat. No. 4,420,554 (corresponding to JP-A-57-136640), JP-A-57-135945 (corresponding to U.S. Patent 4,420,554), JP-A-57-188035, JP-A-58-98728, and JP-A-58-209737; a group which releases PUG on intramolecular cyclization reaction of an oxy group formed through electron transfer to a carbonyl group conjugated with a nitrogen group of a nitrogen-containing hetero ring as disclosed in JP-A-57-56837; a group which releases PUG while forming an aldehyde as disclosed in U.S. Pat. No. 4,146,396 (corresponding to JP-A-52-90932), JP-A-59-93442 (corresponding to U.S. Pat. No. 4,522,917) and JP-A-59-75475; a group which releases PUG on decarboxylation as disclosed in JP-A-51-146828, JP-A-57-179842, and JP-A-59-104641; a group having a structure of —O—COOC$R_a$$R_b$—PUG (wherein $R_a$ and $R_b$ each represents a hydrogen atom, an alkyl group, an aryl group, a heterocyclic group (in the present invention a heterocyclic group represents a 5- to 8-membered group having at least one N, O and S atoms as hetero atom unless otherwise defined), an acyl group, an alkylsulfonyl group, an arylsulfonyl group and a nitro group) which releases PUG on decarboxylation followed by formation of an aldehyde; a group which releases PUG while forming an isocyanate as disclosed in JP-A-60-7429 (corresponding to U.S. Pat. No. 4,546,073); and a group which releases PUG on coupling reaction with an oxidation product of a color developing agent as disclosed in U.S. Pat. No. 4,438,193.

Specific examples of these divalent linking groups as Time are described in JP-A-61-236549 (corresponding to U.S. Pat. No. 4,770,990) and JP-A-1-269936.

PUG represents a group having a development inhibitory effect either as (Time)$_t$PUG or PUG.

The development inhibitor moiety represented by PUG or (Time)$_t$PUG is a known development inhibitor moiety containing a hetero atom through which it is bonded.

Examples of such a development inhibitor moiety are the same as those of X in formula (II) described above.

$R_1$ or —(Time)$_t$PUG in formula (IV) may contain therein a ballast group generally employed in immobile photographically useful additives, such as couplers, or a group which accelerates adsorption of the compound of formula (IV) onto silver halide grains (hereinafter referred to as an adsorption accelerating group).

The ballast group is an organic group having a sufficient molecular size for substantially preventing the compound of formula (IV) from diffusing into other layers or processing solutions. It comprises at least one of an alkyl group, an aryl group, a heterocyclic group, an ether group, a thioether group, an amido group, a ureido group, an aminocarbonyloxy group, an alkoxycarbonylamino group, an aryloxycarbonylamino group, a sulfonamido group, etc. Preferred ballast groups are those having a substituted benzene ring, and more preferably those having a benzene ring substituted with a branched alkyl group.

Examples of suitable adsorption accelerating groups include a cyclic thioamido group (e.g., 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxadiazoline-2-thione, benzimidazoline-2-thione, benzoxazoline-2-thione, benzothiazoline-2-thione, thiotriazine, and 1,3-imidazolin-2-thione), an acyclic thioamido group, an aliphatic mercapto group, an aromatic mercapto group, a heterocyclic mercapto group (a group wherein the carbon atom on which —SH is bonded is adjacent to a nitrogen atom, i.e., a cyclic thioamido group which is a tautomeric isomer of the heterocyclic mercapto group, and specific examples of such a group are the same as those enumerated above), a group having a disulfide linkage, a 5- or 6-membered nitrogen-containing heterocyclic group comprising a combination of nitrogen, oxygen, sulfur and carbon atoms (e.g., benzotriazole, triazole, tetrazole, indazole, benzimidazole, imidazole, benzothiazole, thiazole, thiazoline, benzoxazole, oxazole, oxazoline, thiadiazole, oxathiazole, triazine, and azaindene), and a heterocyclic quaternary salt (e.g., benzimidazolinium). These groups may further be substituted with an appropriate substituent. Examples of appropriate substituents include those mentioned with respect to the substituents of $R_1$.

Specific examples of the compound represented by formula (IV) are shown below for illustrative purposes only but not for limitation.

IV-1

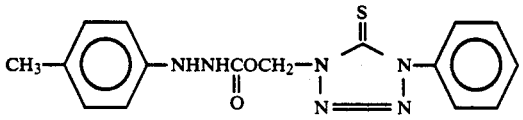

IV-2

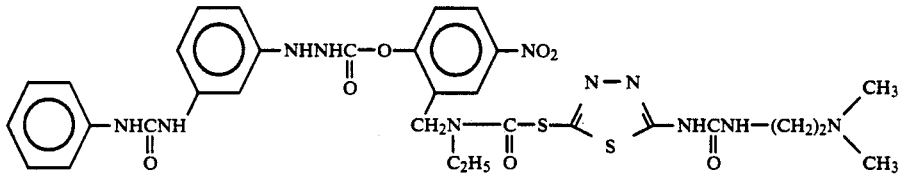

IV-3

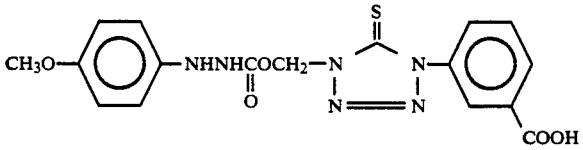

IV-4

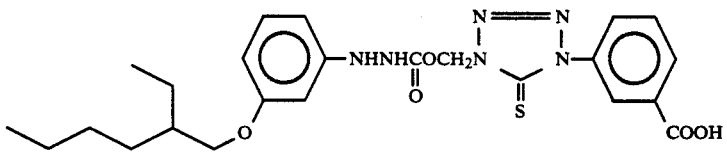

IV-5

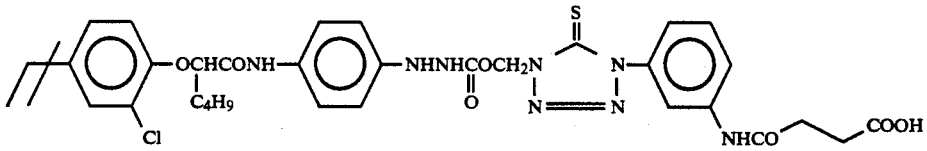

IV-6

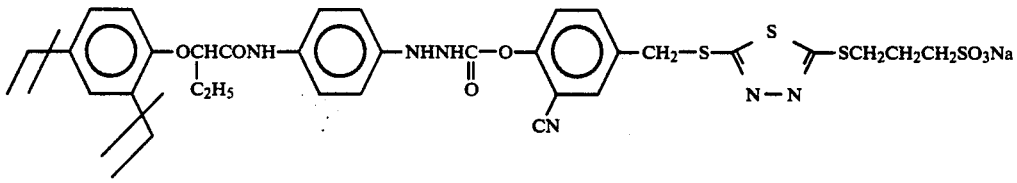

IV-7

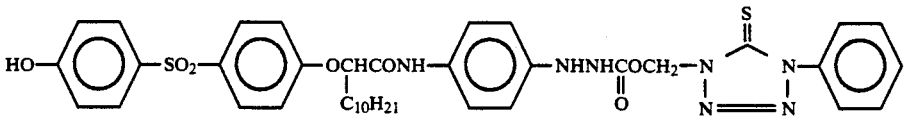

-continued

IV-8

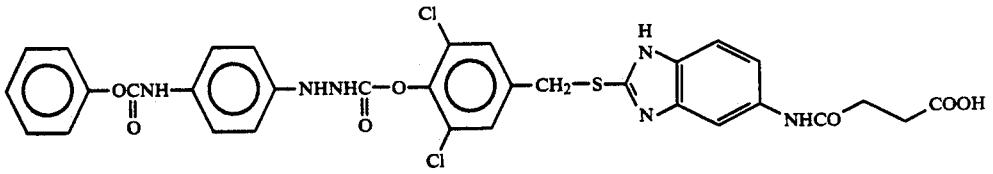

IV-9

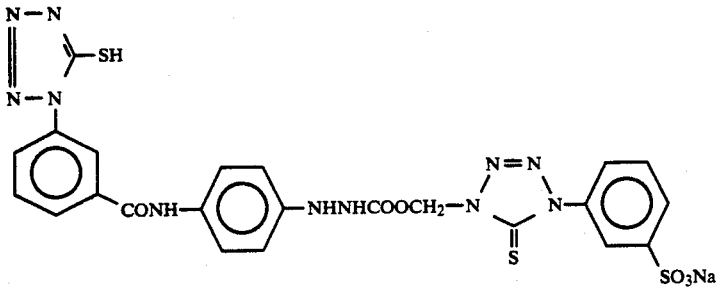

IV-10

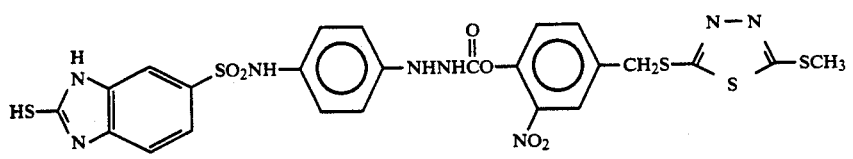

In addition to the above-described redox compounds, the compounds described in JP-A-61-213847, JP-A-62-260153 (corresponding to U.S. Pat. No. 4,684,604), EP 393711A, EP 393721A, EP 393720A, and Japenese Patent Application 1-114455 can also be used in means (2).

Processes for synthesizing redox compounds which can be used in the present invention are described, e.g., in JP-A-61-213847, JP-A-62-260153, U.S. Pat. No 4,684,604, Japanese Patent Application No. Sho-63-98803, U.S. Pat. Nos. 3,379,529, 3,620,746, 4,377,634, and 4,332,878, JP-A-49-129536, JP-A-56-153336, and JP-A-56-153342.

The preferred redox compound is used in an amount ranging from about $1\times10^{-6}$ to about $5\times10^{-2}$ mol, and more preferably from $1.0\times10^{-5}$ to $1\times10^{-2}$ mol, per mole of light-sensitive silver halide in the silver halide emulsion layer when the compound is contained in the silver halide emulsion layer, or in the silver halide emulsion layer adjacent to the light-insensitive hydrophilic colloid layer when the compound is contained in the light-insensitive layer. In the latter case, when both layers adjacent to the light-insensitive layer are silver halide emulsion layer the amount is decided based on the larger amount of the silver halide content between these two emulsion layers (the definition for the amount is the same hereinafater unless otherwise defined).

The redox compound is incorporated into a photographic material by dissolving it an appropriate water-miscible organic solvent, such as alcohols (e.g., methanol, ethanol, propanol, and fluorinated alcohols), ketones (e.g., acetone and methyl ethyl ketone), dimethylformamide, dimethyl sulfoxide, methyl cellosolve. Incorporation of the redox compound can also be carried out by a well-known dispersion method using a mechanically prepared dispersion of the compound in oil (oils include, e.g., dibutyl phthalate, tricresyl phosphate, glyceryl triacetate, and diethyl phthalate) with an auxiliary solvent (auxiliary solvents include, e.g., ethyl acetate and cyclohexane). A solid dispersion method using a powder of the redox compound dispersed in water by means of a ball mill, a colloid mill, or ultrasonic wave may also be employed.

The compound represented by formula (III) shown below which can be used in means (3) is explained below:

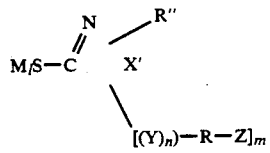

(III)

wherein $M_1$ represents a hydrogen atom, a cation, or a mercapto group-protecting group which is split off with an alkali; X' represents an atomic group necessary to form a 5- or 6-membered heterocyclic ring containing at least one of a sulfur atom, a selenium atom, a nitrogen atom, and an oxygen atom, as a hetero atom, which may be substituted or may be condensed; R represents a straight chain or branched alkylene group, a straight chain or branched alkenylene group, a straight chain or branched aralkylene group, or an arylene group; Z represents a polar substituent; Y represents —S—, —O—,

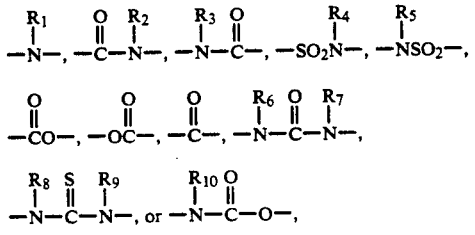

wherein $R_1$, $R_2$, $R_3$, $R_4$, $R_5$, $R_6$, $R_7$, $R_8$, $R_9$, and $R_{10}$ each represents, which may be the same or different, a hydrogen atom, a substituted or unsubstituted alkyl group, a substituted or unsubstituted aryl group, a substituted or unsubstituted alkenyl group, or a substituted or unsubstituted aralkyl group; R″ represents a hydrogen atom or a group capable of substituting for a hydrogen atom; n represents 0 or 1; and m represents 0, 1, or 2.

In formula (III), the cation as $M_1$ includes a sodium ion, a potassium ion, and an ammonium ion. The mercapto group-protecting group as $M_1$ includes —COR′, —COOR′, and —$CH_2CH_2COR'$, wherein R′ represents a hydrogen atom, an alkyl group, an aralkyl group, or an aryl group.

The 5- or 6-membered heterocyclic ring completed by X′ may be condensed with, for example, a phenyl group or a naphthyl group. Examples of the heterocyclic ring completed by X′ include tetrazole, triazole, imidazole, oxazole, thiadiazole, pyridine, pyrimidine, triazine, azabenzimidazole, purine, tetraazaindene, triazaindene, pentaazaindene, benzotriazole, benzimidazole, benzoxazole, benzothiazole, benzoselenazole, and naphthoimidazole rings.

The polar substituent as Z includes a substituted or unsubstituted amino group (inclusive of a salt thereof), a quaternary ammoniumyl group, an alkoxy group, an aryloxy group, an alkylthio group, an arylthio group, a heterocyclic oxy group, a heterocyclic thio group, a sulfonyl group, a carbamoyl group, a sulfamoyl group, a carbonamido group, a sulfonamido group, an acyloxy group, a ureido group, an acyl group, an aryloxycarbonyl group, a thioureido group, a sulfonyloxy group, a heterocyclic group, and a hydroxyl group.

The group capable of substituting for a hydrogen atom as represented by R″ includes a halogen atom (e.g., fluorine, chlorine, bromine), a substituted or unsubstituted alkyl group having from 1 to 6 carbon atoms, a substituted or unsubstituted aryl group having from 6 to 12 carbon atoms, a substituted or unsubstituted alkoxy group having from 1 to 6 carbon atoms, a substituted or unsubstituted aryloxy group having from 6 to 12 carbon atoms, a sulfonyl group having from 1 to 12 carbon atoms, a sulfonamido group having from 1 to 12 carbon atoms, a sulfamoyl group having from 1 to 12 carbon atoms, a carbamoyl group having from 1 to 12 carbon atoms, an amido group having from 2 to 12 carbon atoms, a ureido group having from 1 to 12 carbon atoms, an aryl- or alkoxycarbonyl group having from 2 to 12 carbon atoms, an aryl- or alkoxycarbonylamino group having from 2 to 12 carbon atoms, and a cyano group.

For formula (III), it is preferred that m is 1 or 2 and R represents a substituted or unsubstituted alkylene group; Y represents

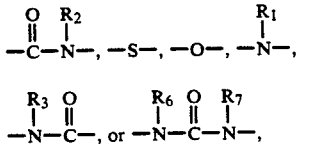

wherein $R_2$, $R_3$, $R_6$, and $R_7$ each represents a hydrogen atom; and Z represents a substituted or unsubstituted amino group or a salt thereof or a heterocyclic group.

Examples of these preferred compounds of formula (III) are shown below.

(III-1)

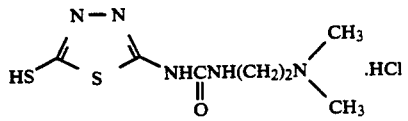

(III-2)

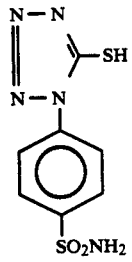

(III-3)

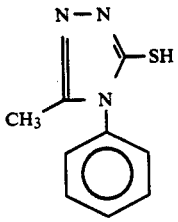

(III-4)

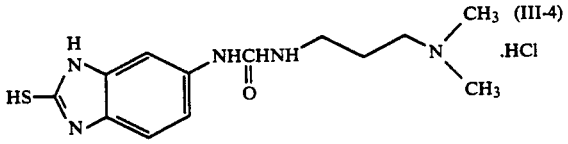

(III-5)

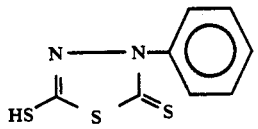

(III-6)

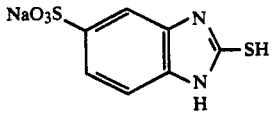

(III-7)

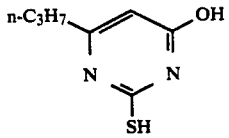

(III-8)

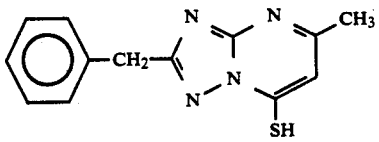

(III-9)

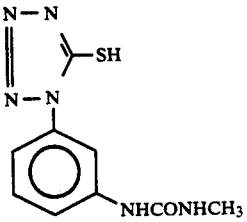

-continued

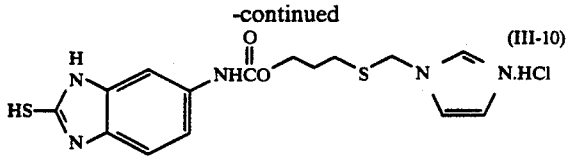

(III-10)

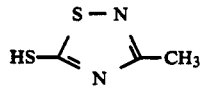

(III-11)

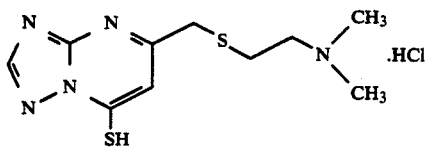

(III-12)

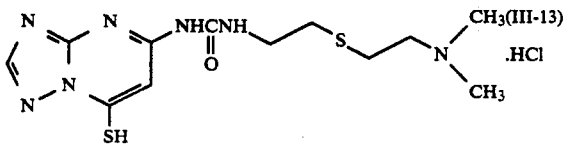

(III-13)

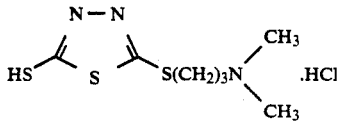

(III-14)

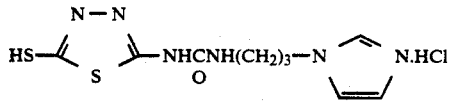

(III-15)

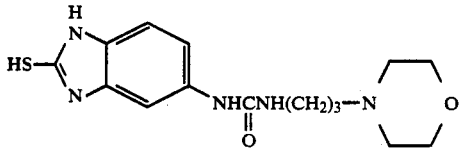

(III-16)

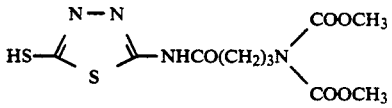

(III-17)

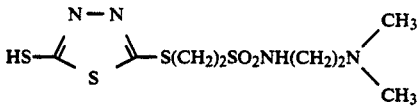

(III-18)

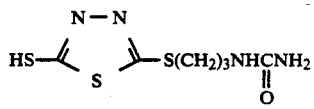

(III-19)

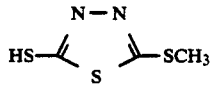

(III-20)

The compound of formula (III) is preferably incorporated into at least one light-sensitive silver halide emulsion layer. Where there are two or more light-sensitive layers having the same color sensitivity but different photosensitivity, the compound of formula (III) is preferably added to at least one light-sensitive layer other than the layer having the highest sensitivity.

The amount of the compound of formula (III) to be added preferably ranges from about $1\times10^{-6}$ to about 1 mol, and more preferably from $1\times10^{-5}$ to 1 mol, per mol of light-sensitive silver halide.

The diffusible 4-thiazolin-2-thione compound and N-substituted-4-thiazolin-2-thion compound which can be used in means (4) are described in U.S. Pat. No. 3,536,487 and JP-B-48-34169, respectively. An example of compound is

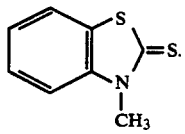

The amount of the compound used in means (4) to be added preferably ranges from about $1\times10^{-6}$ to about 1 mol, and more preferably from $1\times10^{-4}$ to $1\times10^{-1}$ mol, per mol of light-sensitive silver halide. It is preferred that the compound is added to a light-sensitive emulsion layer.

The silver halide emulsion comprising surface-fogged silver halide grains which can be used in means (5) and the silver halide emulsion comprising internally-fogged silver halide grains which can be used in means (6) are described in U.S. Pat. No. 4,082,553 and U.S. Pat. No. 4,626,498, respectively.

The terminology "internally-fogged or surface-fogged silver halide emulsion" as used herein means a silver halide emulsion which is evenly (non-imagewise) developed, exposed or unexposed, without distinction.

The internally-fogged silver halide emulsion is an emulsion comprising core/shell type silver halide grains comprising an internal nucleus having its surface fogged and an outer shell covering the surface of the internal nucleus. Relatively little development occurs in the initial stage of development. However, 30% or more of the total silver thereof is developed in color reversal development involving a sensitizing treatment and a desensitizing treatment irrespective of whether the emulsion is exposed to light or not.

The surface-fogged silver halide emulsion can be prepared by adding a reducing agent or a gold salt to an emulsion capable of forming a surface latent image under appropriate pH and pAg conditions, heating an emulsion capable of forming a surface latent image under a low pAg condition, or uniformly exposing an emulsion capable of forming a surface latent image to light. Examples of suitable reducing agents are stannous chloride, hydrazine compounds, and ethanolamine.

The surface-fogged silver halide emulsion may also have the inside of the grains fogged.

The internally-fogged silver halide emulsion can be prepared by depositing silver halide on the surface of the above-described surface-fogged silver halide grains to form an outer shell.

The dissolving physical development can be controlled in accordance with the timing of the development by varying the thickness of the outer shell of the internally-fogged core/shell type silver halide grains.

The suitable thickness of the outer shell varies depending on the development processing, development time, timing of development of each light-sensitive silver halide emulsion layer, and the like. Satisfactory results can be obtained usually by setting the thickness between about 30 and about 1,000 Å, preferably between 50 and 500 Å.

In the internally-fogged core/shell type silver halide grains, the core and the outer shell may have either the same or different halogen composition.

The internally-fogged or surface-fogged silver halide grains may have any halogen composition selected from, e.g., silver chloride, silver chlorobromide, silver iodobromide, or silver chloroiodobromide.

While these fogged silver halide grains are not particularly limited in grain size, a preferred mean grain size is from about 0.01 to about 0.75 μm, and more preferably from 0.05 to 0.6 μm.

The fogged silver halide grains are not particularly limited in crystal form, either regular or irregular. A poly-dispersed emulsion can be used, but a mono-dispersed emulsion (in which at least 95% of the weight or number of silver halide grains have a grain size falling within ±40% of a mean grain size) is preferred.

The internally-fogged or surface-fogged silver halide emulsion is incorporated into at least one silver halide light-sensitive layer farthest from the support or at least one other layer between the farthest layer and the support, and is preferably incorporated into a silver halide light-sensitive layer and/or a substantially light-insensitive hydrophilic colloidal layer adjacent thereto.

Where there are two or more light-sensitive layers having the same color sensitivity but different light-sensitivity, the internally-fogged or surface-fogged silver halide emulsion is preferably incorporated into a layer other than the layer having the highest sensitivity and/or a substantially light-insensitive hydrophilic colloidal layer adjacent thereto.

The amount of the internally-fogged or surface-fogged silver halide to be added preferably ranges from about 0.05 to about 50 mol %, and more preferably from 0.1 to 40 mol %, based on the light-sensitive silver halide present in the layer to which it is added or in at least one light-sensitive silver halide layer adjacent to the layer to which it is added, but may vary depending on the development conditions, timing of development of each layer, and the like.

Addition of colloidal silver as described in means (7) is described in *Research Disclosure,* No. 131, p. 13116.

In means (7), colloidal silver is incorporated into at least one of silver halide emulsion layers and light-insensitive layers (other than a yellow filter layer and an antihalation layer) adjacent thereto, and preferably into a low sensitivity green-sensitive silver halide emulsion layer, a low sensitivity red-sensitive silver halide emulsion layer, and a substantially light-insensitive hydrophilic colloidal layer adjacent to these light-sensitive layers.

The preferred amount of the colloidal silver is $1\times10^{-4}$ to $3\times10^{-1}$ mol per mol of light-sensitive silver halide. The mean grain size of the colloidal silver is from 0 005 to 0.2 μm.

The electron donor-releasing coupler as described in means (8) is described in JP-A-61 102646, JP-A-61-13060, and JP-A-61-84646 (corresponding to U.S. Pat. No. 4,741,994). There is, for example, the following compound:

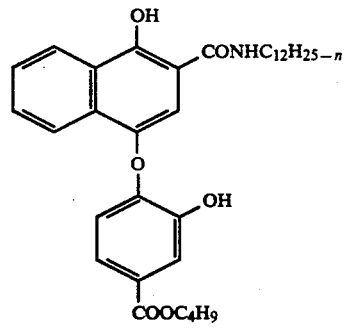

The electron donor-releasing coupler of means (8) may be incorporated into at least one of light-sensitive layers and light-insensitive layers, and it is preferably incorporated into a light-sensitive silver halide emulsion layer. Where there are two or more light-sensitive layers having the same color sensitivity but different photosensitivity, it is preferably incorporated into a layer other than the layer having the highest sensitivity.

The coupler content is preferably from $2\times10^{-1}$ to $1\times10^{-3}$ mol per mol of the light-sensitive silver halide.

Preferred embodiments of the present invention include:

1. A silver halide color reversal light-sensitive material, wherein at least one of a red-sensitive emulsion layer and a green-sensitive emulsion layer comprises two or more layers having different sensitivity and a lower sensitivity layer in these layers has a higher silver iodide content than the higher sensitivity layer in these layers.

More preferably both of red- and green-sensitive layers satisfies this requirement.

A preferred silver iodide content in the silver halide in the low sensitivity red- or green-sensitive layer is from 1.5 to 6 mol %, and that of in the high sensitivity red- or green-sensitive layer is from 1 to 5 mol %. The difference of the iodide content between the low and high sensitivity layers is preferably from 0.2 to 5.0 mol %.

2. A silver halide color reversal light-sensitive material, wherein at least one of a red-sensitive emulsion layer and a green-sensitive emulsion layer comprises two or more layers having different sensitivity, and the lowest sensitivity layer in these layers and/or at least one substantially light-insensitive hydrophilic colloidal layer adjacent thereto being provided with interimage effect-producing means (1) and at least one of (2), (3), (5), and (6).

More preferably both of red- and green-sensitive layers satisfies this requirement.

Preferred embodiments of the present invention further include:

3. A silver halide color reversal light-sensitive material, wherein at least one of a red-sensitive emulsion layer and a green-sensitive emulsion layer comprises three or more layers having different sensitivity, and a low sensitivity layer in said three or more layers has a higher silver iodide content than the middle and high sensitivity layers, and a higher sensitivity layer having a lower silver iodide content than the middle sensitivity layer.

A preferred silver iodide content in the low and high sensitivity layers and the difference thereof between them are the same as described in 3 above.

4. A silver halide color reversal light-sensitive material, wherein at least one of a red-sensitive emulsion layer and a green-sensitive emulsion layer comprises three or more layers having different sensitivity and at least one of the lowest sensitivity layer and/or at least one substantially light-insensitive hydrophilic colloidal layer adjacent thereto being provided with interimage effect-producing means (1) and at least one of (2), (3), (5), and (6).

5. A silver halide color reversal light-sensitive material, wherein at least one of the conditions described in 1 through 4 above is satisfied, and in order to satisfy relationship (a), a cyan coupler is incorporated into at least one of the green-sensitive layer having the highest sensitivity, a substantially light-insensitive hydrophilic colloidal layer adjacent to the highest sensitivity green-sensitive layer, the blue-sensitive layer having the highest sensitivity, and a substantially light-insensitive hydrophilic colloidal layer adjacent to the highest sensitivity blue-sensitive layer. The preferred amount of the coupler is such that it can provide maximum coloring density of from 0.03 to 0.40.

6. A silver halide color reversal light-sensitive material, wherein at least one of the conditions described in 1 through 4 above is satisfied, and in order to satisfy relationship (b), a magenta coupler is incorporated into at least one of the red-sensitive layer having the highest sensitivity, a substantially light-insensitive hydrophilic colloidal layer adjacent to the highest sensitivity red-sensitive layer, the blue-sensitive layer having the highest sensitivity, and a substantially light-insensitive hydrophilic colloidal layer adjacent to the highest sensitivity blue-sensitive layer. The preferred amount of the coupler is such that it can provide maximum coloring density of from 0.03 to 0.40.

The light-sensitive material according to the present invention comprises a support having thereon at least one of a blue-sensitive silver halide emulsion layer, a green-sensitive silver halide emulsion layer, and a red-sensitive silver halide emulsion layer. The number and order of silver halide emulsion layers and light-insensitive layers are not particularly limited. A typical material may comprise a support having thereon the above-described light-sensitive silver halide emulsion layers, in which at least one of the light-sensitive layers comprises two or more emulsion layers having substantially the same color sensitivity to blue light, green light or red light but different photosensitivity (hereinafter referred to as a unit light-sensitive layer). Multi-layer silver halide color photographic materials generally comprise a support having thereon a red-sensitive unit layer nearest to the support, a green-sensitive unit layer, and a blue-sensitive unit layer in this order. Depending on the end use, the above order of layers may be altered, or two layers having the same color sensitivity may have therebetween a layer having different color sensitivity.

A light-insensitive layer, including various intermediate layers, may be provided between these silver halide light-sensitive layers or as an uppermost or undermost layer.

Such intermediate layers may contain couplers and DIR compound as described in JP-A-61-43748, JP-A-59-113438, JP-A-59-113440, JP-A-61-20037, and JP-A-61-20038 and may also contain a color mixing inhibitor as is known in the art.

Each unit light-sensitive layer preferably has a two-layer structure composed of a high sensitivity layer and a low sensitivity layer as described in West German Patent 1,121,470 and British Patent 923,045. The two layers of each unit light-sensitive layer are generally provided in a descending order of photosensitivity toward the support. Between the two silver halide emulsion layers, a light-insensitive layer may be provided. It is also possible to provide a low sensitivity emulsion layer on the side farther from the support and a high sensitivity emulsion layer on the side closer to the support as described in JP-A-57-112751, JP-A-62-200350, JP-A-62-206541, and JP-A-62-206543.

Specific examples of practical layer orders include an order of low sensitivity blue-sensitive layer (BL)/high sensitivity blue-sensitive layer (BH)/high sensitivity green-sensitive layer (GH)/low sensitivity green-sensitive layer (GL)/high sensitivity red-sensitive layer (RH)/low sensitivity red-sensitive layer (RL)/support, an order of BH/BL/GL/GH/RH/RL/support, and an order of BH/BL/GH/GL/RL/RH/support.

A layer order of blue-sensitive layer/GH/RH/GL/RL/support as described in JP-B-55-34932 and a layer order of blue-sensitive layer/GL/RL/GH/RH/support as described in JP-A-56-25738 and JP-A-62-63936 are also employable.

Further, a unit light-sensitive layer may be composed of three layers whose photosensitivity differs in a descending order toward the support, i.e., the highest sensitivity silver halide emulsion layer as the upper layer, a middle sensitivity silver halide emulsion layer as an intermediate layer, and the lowest sensitivity silver halide emulsion layer as the lower layer, as proposed in JP-B-49-15495. Three layers of different sensitivity may also be arranged in an order of middle sensitivity emulsion layer/high sensitivity emulsion layer/low sensitivity emulsion layer/support as described in JP-A-59-202464.

In addition, an order of high sensitivity emulsion layer/low sensitivity emulsion layer/middle sensitivity emulsion layer or an order of low sensitivity emulsion layer/middle sensitivity emulsion layer/high sensitivity emulsion layer can also be used.

Where a unit light-sensitive layer is composed of four or more layers, the order of layers can be similarly altered.

As mentioned above, a layer structure or arrangement of light-sensitive materials can be appropriately chosen according to the end use.

Silver halide which can be preferably used in photographic emulsion layers includes silver iodobromide, silver iodochloride and silver iodochlorobromide, each containing not more than about 10 mol % of silver iodide. A more preferred silver halide is silver iodobromide or silver iodochlorobromide each containing from about 2 to about 10 mol % of silver iodide. Silver chloride is preferably contained in iodochlorobromide in an amount of not more than 10 mol %.

Silver halide grains in the photographic emulsions may have a regular crystal form, such as a cubic form, an octahedral form, and a tetradecahedral form; an irregular crystal form, such as a spherical form and a plate form; a crystal form having a crystal defect, such as a twinning plane; or a composite crystal form thereof.

The silver halide grains have a wide range of grain size, including fine grains of about 0.2 μm or smaller to large grains having a projected area diameter reaching about 10 μm. The silver halide emulsion may be either a mono-dispersed emulsion or a poly-dispersed emulsion.

Silver halide photographic emulsions which are used in the present invention can be prepared by the processes described, e.g., in *Research Disclosure,* No. 17643 (Dec., 1978), pp. 22–23, "I. Emulsion Preparation and Types", ibid, No. 18716 (Nov., 1979), p. 648, and ibid, No. 307105 (Nov., 1989), p. 863 to p. 865, P. Glafkides, *Chemie et Phisique Photographique,* Paul Montel (1967), G. F. Duffin, *Photographic Emulsion Chemistry,* Focal Press (1966), and V. L. Zelikman et al., *Making and Coating Photographic Emulsion,* Focal Press (1964).

Mono-dispersed emulsions described in U.S. Pat. Nos. 3,574,628 and 3,655,394 and British Patent 1,413,748 are preferably used as well.

Tabular grains having an aspect ratio of about 3 or more are also useful. Such tabular grains can easily be prepared by the processes described, e.g., in Gutoff, *Photographic Science and Engineering,* Vol. 14, pp. 248–257 (1970), U.S. Pat. Nos. 4,434,226, 4,414,310, 4,433,048, and 4,439,520, and British Patent 2,112,157.

The silver halide grains may be homogeneous grains having a uniform crystal structure throughout the individual grains or heterogeneous grains including those in which the inner portion and the outer portion have different halogen compositions, those in which the halogen composition differs among these portions, and those having silver halide of different halogen composition fused thereto through epitaxy. Silver halide grains fused with compounds other than silver halides, e.g., silver rhodanide or lead oxide, may also be used. A mixture comprising grains of various crystal forms is employable.

The photographic emulsions may be either of surface latent image type which forms a latent image predominantly on the grain surface, of internal latent image type which forms a latent image predominantly in the inside of grains, or of a type which forms a latent image both on the grain surface and in the inside of grains, but should be of negative type. The internal latent image type emulsion may be a core/shell type internal latent image type emulsion as described in JP-A-63-264740. Preparation of such a core/shell type internal latent image type emulsion is described in JP-A-59-133542. The thickness of the outer shell of this type preferably ranges from about 3 to about 40 nm, and more preferably from 5 to 20 nm, but may vary depending on the development processing conditions, among other factors.

Silver halide emulsions are usually subjected to physical ripening, chemical ripening, and spectral sensitization. Additives to be used in these steps are described in *Research Disclosure* (hereinafter abbreviated as RD) Nos. 17643, 18716 and 307105 as summarized in Table hereinafter described.

In the light-sensitive material of the present invention, a mixture of two or more light-sensitive emulsions differing in at least one characteristic including grain size, grain size distribution, halogen composition, grain form, and sensitivity can be used in the same layer.

In the present invention, light-insensitive silver halide fine grains are preferably used. The terminology "light-insensitive silver halide fine grains" as used herein means silver halide fine grains which are not sensitive to light of imagewise exposure for obtaining a color image and are therefore not substantially developed during development processing. It is preferable that the light-insensitive silver halide fine grains are not previously fogged.

The silver halide fine grains are preferably incorporated into a light-insensitive hydrophilic colloid layer, and more preferably they are incorporated into a layer which is present at the most far away position from the support than the light-sensitive layer which is present at the most far away position from the support.

The silver halide fine grains have a silver bromide content of from 0 to 100 mol % and may contain, if desired, silver chloride and/or silver iodide. The silver halide fine grains preferably have a silver iodide content of from 0.5 to 10 mol % and a silver chloride content of not more than 30 mol %.

The silver halide fine grains preferably have a mean particle size (an average circle-equivalent diameter of the projected area) of from 0.01 to 0.5 μm, and more preferably from 0.02 to 0.2 μm.

The silver halide fine grains can be prepared in the same manner as for general light-sensitive silver halide grains. The surface of silver halide grains formed does not need to be either optically sensitized or spectrally sensitized. It is preferable, however, that a known stabilizer, such as triazole compounds, azaindene compounds, benzothiazolium compounds, mercapto compounds, and zinc compounds, be added before the silver halide fine grains are added to a coating composition. The layer containing the silver halide fine grains preferably contains colloidal silver.

The light-sensitive material of the present invention preferably has a silver coverage (the total silver content including all silver amount in silver compounds and metal silver such as silver in light-sensitive and insensitive silver halide and colloidal silver) of not more than about 6.0 g/m$^2$, and more preferably not more than about 5.5 g/m$^2$.

Known photographic additives which can be used in the present invention are described in the above-described RD Nos. 17643, 18716, and 30710 supra as tabulated below.

| Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | | p. 648, right column (RC) | |
| 3. Spectral Sensitizer, Supersensitizer | pp. 23–24 | p. 648, RC to p. 649, RC | pp. 866–868 |
| 4. Brightening Agent | p. 24 | p. 647, RC | p. 868 |
| 5. Antifoggant and Stabilizer | pp. 24–25 | p. 649, RC | pp. 868–870 |
| 6. Light Absorber, Filter Dye, Ultrasonic Absorber | pp. 25–26 | p. 649, RC to p. 650, left column (LC) | p. 873 |
| 7. Stain Inhibitor | p. 25, RC | p. 650, LC to RC | p. 872 |
| 8. Dye Image Stabilizer | p. 25 | p. 650, LC | " |
| 9. Hardening Agent | p. 26 | p. 651, LC | pp. 874–875 |
| 10. Binder | p. 26 | " | pp. 873–874 |
| 11. Plasticizer, Lubricant | p. 27 | p. 650, RC | p. 876 |
| 12. Coating Aid, Surface Active Agent | pp. 26–27 | p. 650, RC | pp. 875–876 |
| 13. Antistatic Agent | p. 27 | " | pp. 876–877 |
| 14. Matting Agent | | | pp. 878–879 |

In order to prevent photographic performance deterioration due to contact with formaldehyde gas, the light-sensitive material of the present invention preferably contains a compound capable of reacting with formaldehyde to fix it as described in U.S. Pat. Nos. 4,411,987 and 4,435,503.

In order to increase the interimage effects, a mercapto compound as described in U.S. Pat. Nos. 4,740,454 and 4,788,132, JP-A-62-18539 (corresponding to U.S. Pat. No. 4,740,454), and JP-A-1-283551 is preferably added to the light-sensitive material of the present invention.

The light-sensitive material can further contain a compound capable of releasing a fogging agent, a development accelerator, a silver halide solvent, or a precursor of these compounds irrespective of the amount of developed silver as described in JP-A-1-106052.

The light-sensitive material preferably contains a dye dispersed by the process described in WO 88/04794 and Published PCT Application (in Japan) 1-502912 or a dye described in EP 317308A, U.S. Pat. No. 4,420,555 and JP-A-1-259358.

Various couplers can be used in the light-sensitive material of the present invention. Specific examples of useful couplers are described in patents cited in RD, No. 17643, VII-C to G and RD, No. 307105, VII-C to G.

Examples of suitable yellow couplers are described, e.g., in U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of suitable magenta couplers include 5-pyrazolone couplers and pyrazoloazole couplers. Examples of particularly preferred magenta couplers are described in U.S. Pat. Nos. 4,310,619 and 4,351,897, European Patent 73,636, U.S. Pat. Nos. 3,061,432 and 3,725,064, RD, No. 24220 (Jun., 1984), JP-A-60-33552, RD, No. 24230 (Jun., 1984), JP-A-60-43659, JP-A-61-72238, JP-A-60-35730, JP-A-55-118034, JP-A-60-185951, U.S. Pat. Nos. 4,500,630, 4,540,654, and 4,556,630, and WO 88/04795.

Cyan couplers include phenol couplers and naphthol couplers. Examples of suitable couplers are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication No. 3,329,729, EP 121,365A, EP 249,453A, U.S. Pat. Nos. 3,446,622, 4,333,999, 4,775,616, 4,451,559, 4,427,767, 4,690,889, 4,254,212, and 4,296,199, and JP-A-61-42658.

Typical examples of polymerized dye-forming couplers are described in U.S. Pat. Nos. 3,451,820, 4,080,211, 4,367,282, 4,409,320, and 4,576,910, British Patent 2,102,173, and EP 341,188A.

Examples of suitable couplers which develop a dye having moderate diffusibility are described in U.S. Pat. No. 4,366,237, British Patent 2,125,570, European Patent 96,570, and West German Patent (OLS) No. 3,234,533.

Examples of suitable colored couplers which can be used for correcting unnecessary absorption of a developed dye are described in RD, No. 17643, VII-G, RD, No. 307105, VII-G, U.S. Pat. No. 4,163,670, JP-B-57-39413, U.S. Pat. Nos. 4,004,929 and 4,138,258 and British Patent 1,146,368. Further, couplers capable of releasing a fluorescent dye upon coupling by which unnecessary absorption of a developed dye is corrected as described in U.S. Pat. No. 4,774,181 and couplers having a dye precursor group as a releasable group which is capable of reacting with a developing agent to form a dye as described in U.S. Pat. No. 4,777,120 are preferably used.

Couplers capable of releasing a photographically useful residue on coupling are also advantageous. Examples of suitable DIR couplers which release a development inhibitor are described in patents cited in RD, No. 17643, VII-F, RD, No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Examples of suitable couplers which imagewise release a nucleating agent or a development accelerator at the time of development are described in British Patents 2,097,140 and 2,131,188, JP-A-59-157638, and JP-A-59-170840. Compounds which release a fogging agent, a development accelerator, a silver halide solvent, among other components, upon oxidation-reduction reaction with an oxidation product of a developing agent as described in JP-A-60-107029, JP-A-60-252340, JP-A-1-44940, and JP-A-1-45687 are also preferably used.

Other compounds which can be used in the light-sensitive material of the present invention include competing couplers as described in U.S. Pat. No. 4,130,427; poly-equivalent couplers as described in U.S. Pat. Nos. 4,283,472, 4,338,393, and 4,310,618; couplers capable of releasing a DIR redox compound, a DIR coupler-releasing couplers, a DIR coupler-releasing redox compound, or a DIR redox-releasing redox compound as described in JP-A-60-185950 and JP-A-62-24252; couplers capable of releasing a dye which restores its color after release as described in EP 173,302A and EP 313,308A; couplers capable of releasing a bleaching accelerator as described in RD, No. 11449, RD, No. 24241, and JP-A-61-201247; couplers capable of releasing a ligand as described in U.S. Pat. No. 4,555,477; couplers capable of releasing a leuco dye as described in JP-A-63-75747; and couplers capable of releasing a fluorescent dye as described in U.S. Pat. No. 4,774,181.

These couplers are introduced into photographic materials by various known dispersion methods.

High-boiling organic solvents which are useful in an oil-in-water type dispersion method are described, e.g., in U.S. Pat. No. 2,322,027. Specific examples of the high-boiling organic solvents having a boiling point of 175° C. or higher under atmospheric pressure are phthalic esters (e.g., dibutyl phthalate, dicyclohexyl phthalate, di-2-ethylhexyl phthalate, decyl phthalate, bis(2,4-di-t-amylpheny) phthalate, bis(2,4-di-t-amylphenyl)isophthalate, bis(1,1-diethylpropyl) phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic acid esters (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-t-amylphenol), aliphatic carboxylic acid esters (e.g., bis(2-ethylhexyl) sebacate, dioctyl azelate, glycerol tributyrate, isostearyl lactate, trioctyl citrate), aniline derivatives (e.g., N,N-dibutyl-2-butoxy-5-t-octylaniline), and hydrocarbons e.g., paraffin, dodecylbenzene, diisopropylnaphthalane). Organic solvents having a boiling point of not lower than about 30° C., and preferably from about 50° C. to about 160° C. may be used in combination as an auxiliary solvent. Typical examples of such an auxiliary solvent are ethyl acetate, butyl acetate, ethyl propionate, methyl ethyl ketone, cyclohexanone, 2-ethoxyethyl acetate, and dimethylformamide.

With respect to a latex dispersion method, the steps involved, the effects, and specific examples of loadable latices are described in U.S. Pat. No. 4,199,363 and West German Patent (OLS) Nos. 2,541,274 and 2,541,230.

The color light-sensitive material of the present invention preferably contains various antiseptic agents or antifungal agents, such as phenethyl alcohol and those described in JP-A-63-257747, JP-A-62-272248 and JP-A-1-80941 (e.g., 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole).

Suitable supports which can be used in the color light-sensitive materials are described, e.g., in RD, No. 17632, p. 28, RD, No. 18716, pp. 647 (right column) to 648 (left column), and RD, No. 307105, p. 879.

In the light-sensitive material of the present invention, the hydrophilic colloidal layers on the side having emulsion layers preferably have a total film thickness of not more than about 28 μm, more preferably not more than 23 μm, even more preferably not more than 18 μm, and most preferably not more than 16 μm, and a rate of swell $T_{\frac{1}{2}}$ of not more than about 30 seconds, and more preferably not more than 20 seconds. The terminology "total film thickness" as used herein means a total film thickness as measured after conditioning at 25° C. and a relative humidity of 55% for 2 days. The terminology "rate of swell $T_{178}$" means the time required for a light-sensitive material to be swollen to ½ the saturated swollen thickness, the saturated swollen thickness being defined to be 90% of the maximum swollen thickness which is reached when the color light-sensitive material is swollen with a color developing solution at 30° C. for 3 minutes and 15 seconds. The rate of swell can be determined by methods known in the art using, for example, a swellometer of the type described in A. Green, et al., *Photographic Science and Engineering*, Vol. 19, No. 2, pp. 124–129.

The rate of swell $T_{\frac{1}{2}}$ can be controlled by adding a hardening agent for a gelatin binder or by varying aging conditions after coating.

Further, the light-sensitive material preferably has a degree of swelling of from about 150 to about 400%. The terminology "degree of swelling" as used herein means the value obtained from the maximum swollen film thickness as defined above according to formula: (maximum swollen film thickness − film thickness)/film thickness.

The light-sensitive material of the present invention preferably has at least one hydrophilic colloidal layer having a total dry film thickness of from about 2 to about 20 μm on the side opposite to photographic emulsion layers (hereinafter referred to as backing layer). The backing layer preferably contains the above-enumerated additives, such as light absorbents, filter dyes, ultraviolet absorbents, anti-static agents, hardening agents, binders, plasticizers, lubricants, coating aids, and surface active agents. The backing layer preferably has a degree of swelling of from about 150 to about 500%.

A color developing solution to be used for developing the light-sensitive material according to the present invention is preferably an alkaline aqueous solution containing an aromatic primary amine color developing agent. Useful color developing agents include aminophenol compounds and preferably p-phenylenediamine compounds. Typical examples of p-phenylenediamine compounds are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and salts thereof (e.g., sulfates, hydrochlorides, and p-toluenesulfonates), with 3-methyl-4-amino-N-ethyl-N-β-hydroxyethylaniline sulfate being more preferred. These developing agents may be used either individually or in combination of two or more thereof according to the purpose.

The color developing solution usually contains a pH buffering agent, e.g., carbonates, borates or phosphates of alkali metals, and a development inhibitor or an antifoggant, e.g., chlorides, bromides, iodides, benzimidazoles, benzothiazoles, and mercapto compounds. If desired, the color developing solution further contains various preservatives, such as hydroxylamine, diethylhydroxylamine, sulfites, hydrazines (e.g., N,N-biscarboxymethylhydrazine), phenyl semicarbazides, triethanolamine, catecholsulfonic acids; organic solvents, e.g., ethylene glycol and diethylene glycol; development accelerators, e.g., benzyl alcohol, polyethylene glycol, quaternary ammonium salts, and amines; dye-forming couplers; competing couplers; auxiliary developing agents, e.g., 1-phenyl-3-pyrazolidone; viscosity-imparting agents; and various chelating agents, such as aminopolycarboxylic acids, aminopolyphosphonic acids, alkylphosphonic acids; and phosphonocarboxylic acids (e.g., ethylenediaminetetraacetic acid, nitrilotriacetic acid, ethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts thereof).

Processing steps and processing solutions other than the color developing solution for processing the color reversal light-sensitive materials of the present invention will be explained below.

Of the processing steps involved, steps of from black-and-white (B/W) development through color development can be carried out by any of the following methods.

1) B/W development-washing-reversing-color development
2) B/W development-washing-light reversing-color development
3) B/W development-washing-color development The washing step in (1) to (3) may be replaced by rinsing as described in U.S. Pat. No. 4,804,616 to thereby simplify processing and reduce waste liquor.

Steps subsequent to color development can be carried out in any of the following manners.

4) Color development-conditioning-bleach-fixing-washing-stabilization
5) Color development-washing-bleach-fixing-washing-stabilization
6) Color development-conditioning-bleach-washing-fixing-washing-stabilization
7) Color development-washing-bleach-washing-fixing-washing-stabilization
8) Color development-bleach-fixing-washing-stabilization 9) Color development-bleach-blix (bleach-fix)-washing-stabilization
10) Color development-bleach-blix-fixing-washing-stabilization
11) Color development-bleach-washing-fixing-washing-stabilization
12) Color development-conditioning-blix-washing-stabilization
13) Color development-washing-blix-washing-stabilization
( 14) Color development-blix-washing-stabilization
15) Color development-fixing-blix-washing-stabilization The washing immediately preceding stabilization in (4) to (15) above may be omitted, or alternatively, the final stabilization may be omitted. Any one of (1) to (3) is followed by any one of (4) to (15) to accomplish color reversal processing.

A B/W developing solution to be used for B/W development contains one or more of known developing agents, such as dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds comprised of a 1,2,3,4-tetrahydroquinoline ring fused to an indolene ring as described in U.S. Pat. No. 4,067,872.

If desired, the B/W developing solution may further contain preservatives (e.g., sulfites and bisulfites), buffering agents (e.g., carbonates, boric acid, borates, and alkanolamines), alkali agents (e.g., hydroxides and carbonates), dissolving aids (e.g., polyethylene glycols and esters thereof), pH adjusting agents (e.g., acetic acid or a similar organic acid), sensitizers (e.g., quaternary ammonium salts), development accelerators, surface active agents, defoaming agents, hardening agents, viscosity-imparting agents, and so on.

The B/W developing solution should contain a compound acting as a silver halide solvent. A sulfite added as a preservative as mentioned above usually serves as a silver halide solvent. Specific examples of suitable sulfites and other usable silver halide solvents are KSCN, NaSCN, $K_2SO_3$, $Na_2SO_3$, $K_2S_2O_5$, $Na_2S_2O_5$, $K_2S_2O_3$, and $Na_2S_2O_3$.

The pH of the thus prepared B/W developing solution is adjusted so as to provide desired density and contrast, usually within a range of from about 8.5 to about 11.5.

Sensitizing treatment by using such a B/W developing solution can usually be effected by extending the developing time to up to about three times the time required for standard processing. The time extension for high speed development can be shortened by elevating the processing time.

The color developing solution in color reversal development generally have a pH of from about 10 to about 12. A rate of replenishment for these developing solutions is usually about 3 l or less per $m^2$ of a light-sensitive material, but varies depending on the kind of the light-sensitive material. The replenishment rate may be reduced to about 500 ml/$m^2$ or less by reducing a bromide ion concentration in the replenisher. In the case of reducing the replenishment rate, it is preferable to prevent evaporation or aerial oxidation of the processing solution by minimizing the liquid surface area of the processing tank in contact with air. The contact area between a photographic processing solution and air can be expressed in terms of opening ratio calculated by dividing a contact area ($cm^2$) of the processing solution with air by a volume ($cm^3$) of the processing solution. The opening ratio as defined above is preferably about 0.1 or less, and more preferably between 0.001 and 0.05.

The opening ratio of the processing tank can be adjusted by, for example, putting a barrier, such as a floating cover, on the liquid surface, using a movable cover as described in JP-A-1-82033, or utilizing slit development processing as described in JP-A-63-216050.

Reduction of the opening ratio is preferably applied to not only color development and B/W development but also all the subsequent steps, such as bleach, blix, fixing, washing, and stabilization.

Reduction of a replenishment rate may also be achieved by using a means for suppressing accumulation of a bromide ion in the developing solution.

A reversing bath which can be used after B/W development can contain known fogging agents, such as stannous ion complex salts, e.g., a stannous ion-organic phosphoric acid complex salt (see U.S. Pat. No. 3,617,282), a stannous ion-organic phosphonocarboxylic acid complex salt (see JP-B-56-32616), a stannous ionaminopolycarboxylic acid complex salt (see U.S. Pat. No. 1,209,050); and boron compounds, e.g., boron hydride compounds (see U.S. Pat. No. 2,984,567) and heterocyclic aminoboran compounds (see British Patent 1,011,000). The fogging (reversing) bath has a broad pH range from an acidic to alkaline sides, usually ranging from about 2 to about 12, preferably from 2.5 to 10, and more preferably from 3 to 9. Processing with the reversing bath may be replaced by re-exposure for light reversing. Further, the reversing step may be omitted by adding the above-described fogging agent to a color developing solution.

After color development, the light-sensitive material is subjected to bleach or blix. Bleach or blix may be conducted directly after color development, or an extra step, such as stopping, conditioning, washing and the like, may be inserted between color development and bleach or blix for the purpose of preventing unnecessary after-development or aerial fog and reducing the amount of a color developing solution carried over into a desilvering step or for the purpose of washing away sensitizers or dyes present in the light-sensitive material and the color developing agent impregnated into the light-sensitive material.

The photographic emulsion layers after color development are usually subjected to bleach. Bleach and fixing may be carried out either simultaneously (blix) or separately. For rapid processing, bleach may be followed by blix. Further, the mode of desilvering can be arbitrarily selected according to the end use. For example, blix may be effected using two tanks connected, or fixing may be followed by blix, or blix may be followed by bleach.

Bleaching agents to be used include compounds of polyvalent metals, e.g., iron (III), peracids, quinones, and nitro compounds. Typical bleaching agents include organic complex salts of iron (III), e.g., complex salts with aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanoltetraacetic acid, glycol ether diaminetetraacetic acid) or organic acids (e.g., citric acid, tartaric acid, and malic acid). Preferred agents are aminopolycarboxylic acid iron (III) complexes, e.g., (ethylenediaminetetraacetato)iron (III) salts and (1,3-diaminopropanetetraacetato)iron (III) salts, from the standpoint of rapidness of processing and prevention of environmental pollution. Aminopolycarboxylic acid iron (III) complex salts are particularly useful either in a bleaching bath or in a blix monobath A bleaching bath or blix bath containing these aminopolycarboxylic acid iron (III) complex salts usually has a pH between 4.0 and 8.0. A lower pH is also employed for rapid processing.

If desired, a fixing bath, a blix bath, or a prebath thereof may contain known bleaching accelerators. Useful bleaching accelerators include compounds having a mercapto group or a disulfide group as described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, RD, No. 17129 (Jul., 1978); thiazolidine derivatives as described in JP-A-50-140129; thiourea derivatives as described in JP-B-45-8506, JP-A-52-20832, JP-A-53-32735, and U.S. Pat. No. 3,706,561; iodides as described in West German Patent 1,127,715 and JP-A-58-16235; polyoxyethylene compounds as described in German Patents 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and a bromide ion. Among them, compounds having a mercapto group or a disulfide group are preferred because of their high accelerating effect. The compounds disclosed in U.S. Pat. No. 3,893,858, West German Patent 1,290,812, and JP-A-53-95630 are particularly preferred. In addition, the compounds disclosed in U.S. Pat. No. 4,552,834 are also preferred. These bleaching accelerators may be incorporated into a light-sensitive material. The bleaching accelerators are particularly effective for blix of color light-sensitive materials for photographing.

For the purpose of preventing bleach stain, the bleaching or blix bath preferably contains an organic acid. More preferred organic acids which can be used are those having an acid dissociation constant (pKa) of from about 2 to about 5, e.g., acetic acid and propionic acid.

Fixing agents which can be used in a fixing or blix bath include thiosulfates, thiocyanates, thioether compounds, thioureas, and a large quantity of an iodide, with thiosulfates being commonly employed. Aammonium thiosulfate is preferred. A combined use of a thiosulfate and a thiocyanate, a thioether compound, a thiourea, etc. is also preferred. Preservatives for the fixing or blix bath preferably include sulfites, bisulfites, carbonyl-bisulfite adducts, and sulfinic acid compounds described in EP 294769A.

The fixing or blix bath preferably contains various aminopolycarboxylic acids or organophosphonic acids for stabilization.

The total time of desilvering is preferably as short as possible as long as insufficient desilvering does not result. A preferred desilvering time is from about 1 to about 3 minutes, and more preferably from 1 to 2 minutes. The desilvering temperature is from about 25° to about 50° C., and preferably from 35° to 45° C. In the preferred temperature range, the rate of desilvering is improved, and stain formation after processing is effectively prevented.

It is preferable that desilvering should be performed while reinforcing stirring as much as possible. Methods for achieving reinforced stirring include a method in which a jet stream of a processing solution is made to strike against the surface of the emulsion layer as described in JP-A-62-183460; a method of using a rotating means to enhance stirring effects as described in JP-A-62-183461; a method in which a light-sensitive material is moved with its emulsion surface in contact with a wire blade placed in a processing solution to make turbulence; and a method of increasing a total flow of a circulating processing solution. These stirring means are effective in any of a bleaching bath, a blix bath and a fixing bath. Reinforced stirring appears to accelerate supply of a bleaching agent or a fixing agent to emulsion layers and, as a result, to increase the rate of desilvering.

The above-described means for reinforced stirring is more effective in the case where a bleaching accelerator is used, markedly enhancing acceleration effects and eliminating the fixing inhibitory effect of the bleaching accelerator.

An automatic developing machine which can be used for processing the light-sensitive material preferably has a means for carrying a light-sensitive material as described in JP-A-60-191257, JP-A-60-191258, and JP-A-60-191259. As mentioned in JP-A-60-191257 supra, such a carrying means is highly effective to considerably reduce carry-over of a processing solution from a prebath into a succeeding bath thereby preventing reduction of processing capacity. These means are particularly effective for reduction of processing time or replenishment rate in each processing step.

The silver halide color light-sensitive material after desilvering is generally subjected to washing and/or stabilization.

The amount of washing water to be used in the washing step is selected from a broad range depending on characteristics of the light-sensitive material (e.g., the kind of photographic materials such as couplers), the end use of the light-sensitive material, the temperature of washing water, the number of washing tanks (the number of stages), the replenishing system (e.g., counter-flow system or direct-flow system), and other various conditions. For example, a relationship between the number of washing tanks and the quantity of water in a multi-stage counter-flow system can be obtained by the method described in *Journal of the Society of Motion Picture and Television Engineers*, Vol. 64, pp. 248–253 (May, 1955).

According to the disclosed multi-stage counterflow system, a requisite amount of water can be greatly reduced. On the other hand, bacteria tend to grow in the tank with an increase in water retention time, and suspended bacterial cells adhere to light-sensitive materials. Such a problem can be effectively coped with by adopting a method of reducing calcium and magnesium ions of washing water as described in JP-A-62-288838. It is also effective to use bactericides, such as isothiazolone compounds or thiabendazole compounds as described in JP-A-57-8542; chlorine type bactericides, e.g., chlorinated sodium isocyanurate; and other bactericides described in Horiguchi Hiroshi, *Bokin bobaizai no kagaku*, Sankyo Shuppan (1986), Eisei Gijutsukai (ed.), *Biseibutsu no mekkin, sakkin, bobai gijutsu*, Kogyo Gijutsukai (1982), and Nippon Bokin Bobai Gakkai (ed.), *Bokin bobaizai jiten* (1986), e.g., benzotriazole.

Washing water has a pH usually between about 4 and about 9, and preferably between 5 and 8. Washing conditions, though varying depending on the characteristics or the end use of the light-sensitive material and the like, are usually from about 15° to about 45° C. in temperature and from about 20 seconds to about 10 minutes in time, and preferably from 25° to 40° C. in temperature and from 30 seconds to 5 minutes in time.

The washing step may be followed by or replaced with stabilization processing. Where stabilization is conducted in place of washing, any known stabilizing techniques described, e.g., in JP-A-57 8543, JP-A-58-14834, and JP-A-60-220345 can be utilized. Where washing is followed by stabilization, a stabilizing bath to be used includes a solution containing a dye stabilizer and a surface active agent, which is used as a final bath for color light-sensitive materials for shooting. Suitable dye stabilizers include aldehydes, e.g., formalin and glutaraldehyde, N-methylol compounds, hexamethylenetetramine, and an aldehyde-sulfite adduct. If desired, the stabilizing bath may also contain various chelating agents and antifungal agents.

An overflow accompanying replenishment for washing and/or stabilization may be reused in other processing steps, such as a desilvering step.

In cases where each processing solution is concentrated by vaporization during processing with an automatic developing machine, water is preferably supplied to the processing solution to correct the concentration.

For the purpose of simplifying and speeding up processing, the silver halide color light-sensitive material may contain therein a color developing agent, preferably in the form of a precursor thereof. Examples of color developing agent precursors include indoaniline compounds described in U.S. Pat. No. 3,342,597, Schiff base compounds described in RD, Nos. 14850 and 15159, aldol compounds described in U.S. Pat. No. 3,342,597, RD, No. 13924, metal complex salts described in U.S. Pat. No. 3,719,492, and urethane compounds described in JP-A-53-135628.

If desired, the silver halide color light-sensitive material may further contain therein various 1-phenyl-3-pyrazolidone compounds for the purpose of accelerating color development. Typical examples of these accelerators are described in JP-A-56-64339, JP-A-57-144547, and JP-A-58-115438.

Each of the above-described processing solutions is used at a temperature of from about 10° to about 50° C. and, in a standard manner, from about 33° to about 38° C. Higher processing temperatures may be employed for reducing processing time, or lower temperatures may be employed for improving image quality or stability of the processing solution.

The present invention is now illustrated in greater detail by way of the following Examples, but it should be understood that the present invention is not deemed to be limited thereto.

EXAMPLE 1

Preparation of Sample 101

A 205 μm thick cellulose triacetate film having a subbing layer on both sides thereof was coated with the following layers in the order listed to prepare a multilayer color light-sensitive material (designated Sample 101). Note that effects of the additive used are not limited to those indicated.

| | |
|---|---|
| 1st Layer (Antihalation Layer): | |
| Black colloidal silver | 0.25 g/m$^2$ |
| Gelatin | 1.9 g/m$^2$ |
| Ultraviolet absorbent U-1 | 0.04 g/m$^2$ |
| Ultraviolet absorbent U-2 | 0.1 g/m$^2$ |

-continued

| | |
|---|---|
| Ultraviolet absorbent U-3 | 0.1 g/m$^2$ |
| Compound Cpd-S | 0.1 g/m$^2$ |
| Ultraviolet absorbent U-6 | 0.1 g/m$^2$ |
| Compound Cpd-K | 0.2 g/m$^2$ |
| High-boiling organic solvent Oil-1 | 0.1 g/m$^2$ |
| 2nd Layer (Intermediate Layer): | |
| Gelatin | 0.40 g/m$^2$ |
| Compound Cpd-D | 10 mg/m$^2$ |
| High-boiling organic solvent Oil-3 | 40 mg/m$^2$ |
| 3rd Layer (Intermediate Layer): | |
| Gelatin | 0.4 g/m$^2$ |
| 4th Layer (Low Sensitivity Red-Sensitive Emulsion Layer): | |
| Silver iodobromide emulsion (1:1 by mole mixture of a mono-dispersion of cubic grains having a mean grain size of 0.4 μm and an AgI content of 4 mol % and a mono-dispersion of cubic grains having a mean grain size of 0.3 μm and an AgI content of 4 mol %) spectrally sensitized with sensitizing dyes S-1 and S-2: Ag amount | 0.4 g/m$^2$ |
| Gelatin | 0.8 g/m$^2$ |
| Coupler C-1 | 0.20 g/m$^2$ |
| Coupler C-9 | 0.05 g/m$^2$ |
| Compound Cpd-K | 0.1 g/m$^2$ |
| Compound Cpd-I | 0.03 g/m$^2$ |
| High-boiling organic solvent Oil-2 | 0.10 g/m$^2$ |
| 5th Layer (Middle Sensitivity Red-Sensitive Emulsion Layer): | |
| Silver iodobromide emulsion (mono-dispersion of cubic grains having a mean grain size of 0.5 μm and an AgI content of 4 mol %) spectrally sensitized with sensitizing dyes S-1 and S-2: Ag amount | 0.4 g/m$^2$ |
| Gelatin | 0.8 g/m$^2$ |
| Compound Cpd-L | 5 mg/m$^2$ |
| Coupler C-1 | 0.2 g/m$^2$ |
| Coupler C-2 | 0.05 g/m$^2$ |
| Coupler C-3 | 0.2 g/m$^2$ |
| High-boiling organic solvent Oil-2 | 0.1 g/m$^2$ |
| 6th Layer (High Sensitivity Red-Sensitive Emulsion Layer): | |
| Silver iodobromide emulsion (mono-dispersion of twin grains having a mean grain size of 0.7 μm and an AgI content of 4 mol %) spectrally sensitized with sensitizing dyes S-1, S-2 and S-7: Ag amount | 0.4 g/m$^2$ |
| Gelatin | 1.1 g/m$^2$ |
| Compound Cpd-L | 3 mg/m$^2$ |
| Coupler C-3 | 0.7 g/m$^2$ |
| Coupler C-1 | 0.3 g/m$^2$ |
| Compound Cpd-O | 0.01 g/m$^2$ |
| 7th Layer (Intermediate Layer): | |
| Gelatin | 0.6 g/m$^2$ |
| Compound Cpd-J | 0.1 g/m$^2$ |
| Dye D-1 | 0.02 g/m$^2$ |
| 8th Layer (Intermediate Layer): | |
| Gelatin | 1.0 g/m$^2$ |
| Compound Cpd-T | 0.1 g/m$^2$ |
| Color mixing inhibitor Cpd-A | 0.2 g/m$^2$ |
| Compound Cpd-D | 0.05 g/m$^2$ |
| 9th Layer (Low Sensitivity Green-Sensitive Emulsion Layer): | |
| Silver iodobromide emulsion (1:1 by mole mixture of a mono-dispersion of cubic grains having a mean grain size of 0.4 μm and an AgI content f 4 mol % and a mono-dispersion of cubic grains having a mean grain size of 0.2 μm and an AgI content of 4 mol %) spectrally sensitized with sensitizing dyes S-3 and S-4: Ag amount | 0.5 g/m$^2$ |
| Gelatin | 0.5 g/m$^2$ |
| Coupler C-4 | 0.10 g/m$^2$ |
| Coupler C-7 | 0.10 g/m$^2$ |
| Coupler C-8 | 0.20 g/m$^2$ |

-continued

| | |
|---|---|
| Coupler C-10 | 0.10 g/m$^2$ |
| Compound Cpd-B | 0.03 g/m$^2$ |
| Compound Cpd-E | 0.02 g/m$^2$ |
| Compound Cpd-F | 0.02 g/m$^2$ |
| Compound Cpd-G | 0.02 g/m$^2$ |
| Compound Cpd-H | 0.02 g/m$^2$ |
| Compound Cpd-I | 0.01 g/m$^2$ |
| Compound Cpd-L | 5 mg/m$^2$ |
| High-boiling organic solvent Oil-1 | 0.1 g/m$^2$ |
| High-boiling organic solvent Oil-2 | 0.1 g/m$^2$ |
| 10th Layer (Middle Sensitivity Green-Sensitive Emulsion Layer): | |
| Silver iodobromide emulsion (mono-dispersion of cubic grains having a mean grain size of 0.5 μm and an AgI content of 4 mol %) spectrally sensitized with sensitizing dyes S-3 and S-4: Ag amount | 0.4 g/m$^2$ |
| Gelatin | 0.6 g/m$^2$ |
| Coupler C-4 | 0.1 g/m$^2$ |
| Coupler C-7 | 0.1 g/m$^2$ |
| Coupler C-8 | 0.1 g/m$^2$ |
| Compound Cpd-B | 0.03 g/m$^2$ |
| Compound Cpd-E | 0.02 g/m$^2$ |
| Compound Cpd-F | 0.02 g/m$^2$ |
| Compound Cpd-G | 0.05 g/m$^2$ |
| Compound Cpd-H | 0.05 g/m$^2$ |
| High-boiling organic solvent Oil-2 | 0.01 g/m$^2$ |
| 11th Layer (High Sensitivity Green-Sensitive Emulsion Layer): | |
| Silver iodobromide emulsion (mono-dispersion of tabular grains having a sphere-equivalent mean grain size of 0.6 μm, an AgI content of 4 mol %, and an average diameter/thickness of 7) spectrally sensitized with sensitizing dyes S-3 and S-4: Ag amount | 0.5 g/m$^2$ |
| Gelatin | 1.0 g/m$^2$ |
| Coupler C-4 | 0.4 g/m$^2$ |
| Coupler C-7 | 0.2 g/m$^2$ |
| Coupler C-8 | 0.2 g/m$^2$ |
| Compound Cpd-M | 0.01 g/m$^2$ |
| Compound Cpd-B | 0.08 g/m$^2$ |
| Compound Cpd-E | 0.02 g/m$^2$ |
| Compound Cpd-F | 0.02 g/m$^2$ |
| Compound Cpd-G | 0.02 g/m$^2$ |
| Compound Cpd-H | 0.02 g/m$^2$ |
| Compound Cpd-L | 2 mg/m$^2$ |
| High-boiling organic solvent Oil-1 | 0.02 g/m$^2$ |
| High-boiling organic solvent Oil-2 | 0.02 g/m$^2$ |
| 12th Layer (Intermediate Layer): | |
| Gelatin | 0.6 g/m$^2$ |
| Dye Dye-2 | 0.05 g/m$^2$ |
| 13th Layer (Yellow Filter Layer): | |
| Yellow colloidal silver: Ag amount | 0.1 g/m$^2$ |
| Gelatin | 1.1 g/m$^2$ |
| Compound D-6 | 0.1 g/m$^2$ |
| Compound Cpd-K | 0.3 g/m$^2$ |
| Color mixing inhibitor Cpd-A | 0.01 g/m$^2$ |
| High-boiling organic solvent Oil-1 | 0.01 g/m$^2$ |
| 14th Layer (Intermediate Layer): | |
| Gelatin | 0.6 g/m$^2$ |
| 15th Layer (Low Sensitivity Blue-Sensitive Emulsion Layer): | |
| Silver iodobromide emulsion (1:1 by mole mixture of a mono-dispersion of cubic grains having a mean grain size of 0.4 μm and an AgI content of 4 mol % and a mono-dispersion of cubic grains having a mean grain size of 0.2 μm and an AgI content of 4 mol %) spectrally sensitized with sensitizing dyes S-5 and S-6: Ag amount | 0.6 g/m$^2$ |
| Gelatin | 0.8 g/m$^2$ |
| Compound Cpd-J | 0.01 g/m$^2$ |
| Coupler C-5 | 0.6 g/m$^2$ |
| Compound Cpd-I | 0.01 g/m$^2$ |
| High-boiling organic solvent Oil-2 | 0.02 g/m$^2$ |
| 16th Layer (Middle Sensitivity Blue-Sensitive Emulsion Layer): | |
| Silver iodobromide emulsion (mono-dispersion of cubic grains having a mean grain size of 0.5 μm and an AgI content of 4 mol %) spectrally sensitized with sensitizing dyes S-5 and S-6: Ag amount | 0.4 g/m$^2$ |
| Gelatin | 0.9 g/m$^2$ |
| Compound Cpd-M | 0.01 g/m$^2$ |
| Coupler C-5 | 0.2 g/m$^2$ |
| Coupler C-6 | 0.2 g/m$^2$ |
| Coupler C-11 | 0.2 g/m$^2$ |
| High-boiling organic solvent Oil-2 | 0.02 g/m$^2$ |
| 17th Layer (High Sensitivity Blue-Sensitive Emulsion Layer): | |
| Silver iodobromide emulsion (tabular grains having a sphere-equivalent mean grain size of 0.7 μm, an AgI content of 4 mol %, and an average diameter/thickness of 7) spectrally sensitized with sensitizing dyes S-5 and S-6: Ag amount | 0.4 g/m$^2$ |
| Gelatin | 1.2 g/m$^2$ |
| Compound Cpd-L | 2 mg/m$^2$ |
| Coupler C-6 | 0.7 g/m$^2$ |
| 18th Layer (1st Protective Layer): | |
| Gelatin | 0.7 g/m$^2$ |
| Ultraviolet absorbent U-1 | 0.04 g/m$^2$ |
| Ultraviolet absorbent U-3 | 0.03 g/m$^2$ |
| Ultraviolet absorbent U-4 | 0.03 g/m$^2$ |
| Ultraviolet absorbent U-5 | 0.05 g/m$^2$ |
| Ultraviolet absorbent U-6 | 0.05 g/m$^2$ |
| High-boiling organic solvent Oil-1 | 0.02 g/m$^2$ |
| Formalin scavenger Cpd-C | 0.8 g/m$^2$ |
| Coupler C-1 | 0.01 g/m$^2$ |
| Dye D-3 | 0.05 g/m$^2$ |
| Dye D-4 | 0.02 g/m$^2$ |
| Dye D-5 | 0.01 g/m$^2$ |
| 19th Layer (2nd Protective Layer): | |
| Substantially light-insensitive silver iodobromide fine grains emulsion (average particle size: 0.06 μm; AgI content: 1 mol %): Ag amount | 0.1 g/m$^2$ |
| Yellow colloidal silver (grain size: 0.01 μm) | 0.01 g/m$^2$ |
| Gelatin | 0.4 g/m$^2$ |
| 20th Layer (3rd Protective Layer): | |
| Gelatin | 0.4 g/m$^2$ |
| Polymethyl methacrylate (average particle size: 1.5 μm) | 0.1 g/m$^2$ |
| Methyl methacrylate acrylic acid copolymer (4:6 by mole) (average particle size: 1.5 μm) | 0.1 g/m$^2$ |
| Compound Cpd-P | 0.02 g/m$^2$ |
| Compound Cpd-Q | 0.03 g/m$^2$ |
| Surface active agent SA-1 | 3.0 mg/m$^2$ |
| 21st Layer (Backing Layer): | |
| Gelatin | 8.0 g/m$^2$ |
| Ultraviolet absorbent (equivalent mixture of U-1, U-2, U-3, and U-6) | 0.3 g/m$^2$ |
| High-boiling organic solvent Oil-1 | 0.1 g/m$^2$ |
| 22nd Layer (Backing Protective Layer): | |
| Polymethyl methacrylate (average particle size: 1.5 μm) | 0.1 g/m$^2$ |
| Methyl methacrylate-acrylic acid copolymer (4:6 by mole) (average particle size: 1.5 μm) | 0.1 g/m$^2$ |
| Compound Cpd-P | 0.01 g/m$^2$ |
| Gelatin | 3.0 g/m$^2$ |

Each layer further contained a gelatin hardening agent H-1, a compound Cpd-R, and surface acctive agents for coating and emulsification SA-2, SA-3, SA-4, and SA-5.

Furthermore, 1,2-benzisothiazolin-3-one, 2-phenoxyethanol, and phenethyl alcohol were added as antiseptic and antifungal agents.

The terminology "mono-dispersion" as used above means that the coefficient of variation is 20% or less.

Preparation of Emulsions A and B

A silver bromide cubic emulsion having a mean grain size of 0.15 μm was prepared by a controlled double jet process, and the emulsion was fogged at a low pAg by using a hydrazine and a gold complex salt to prepare a surface-fogged silver halide emulsion (designated Emulsion A).

An internally-fogged silver halide emulsion (designated Emulsion B) was prepared by depositing silver bromide on the surface of grains of Emulsion A thus obtained to form an outer shell having a thickness of 50 Å.

Compounds used in the sample preparation are as follows.

C-1

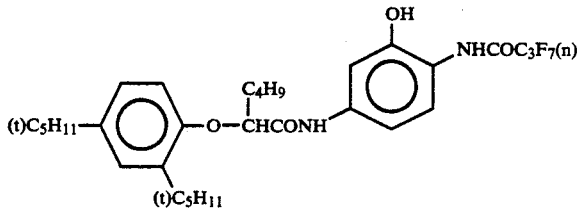

C-2

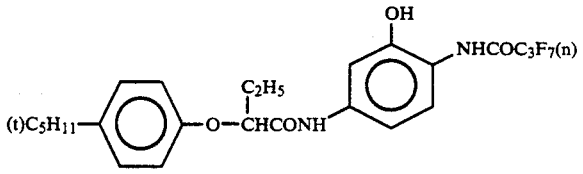

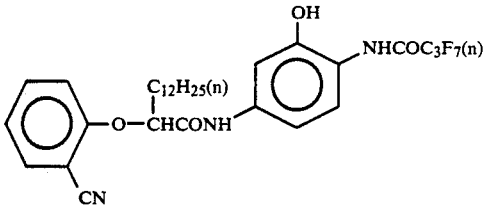

C-3

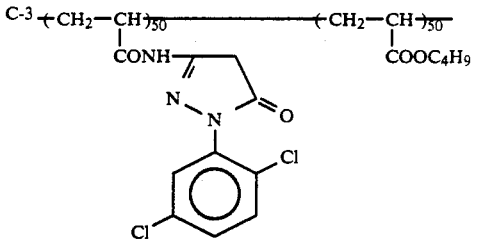

C-4

Copolymerization Ratio: % by weight
Average Molecular Weight:
about 25,000

C-5

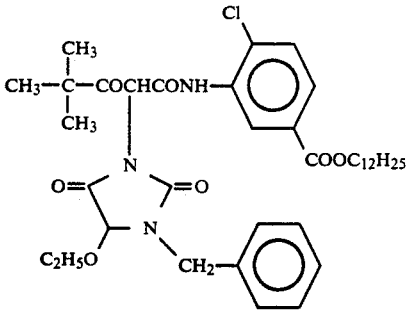

C-6

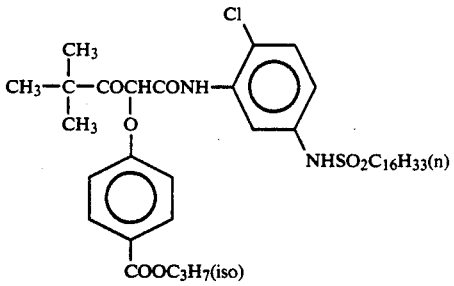

C-7

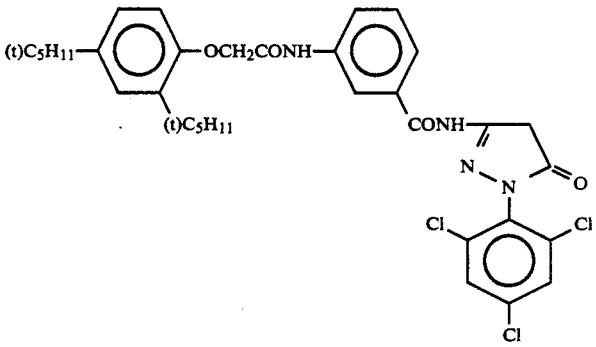

-continued
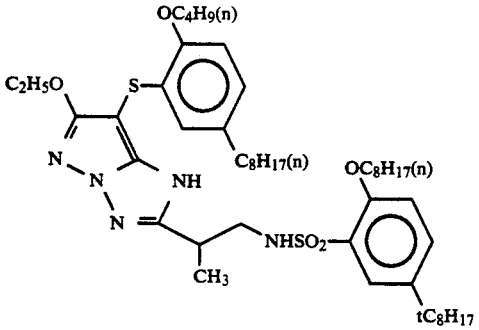
C-8
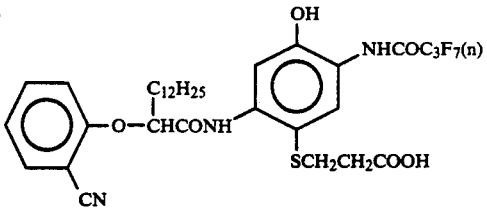
C-9
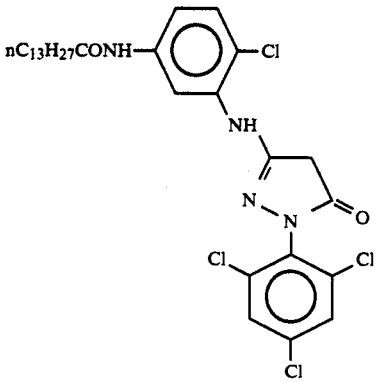
C-10
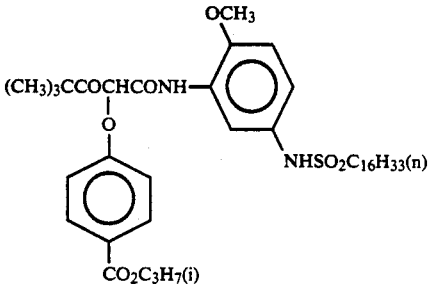
C-11
Dibutyl phthalate Oil-1
Tricresyl phosphate Oil-2
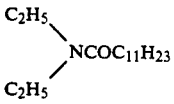
Oil-3
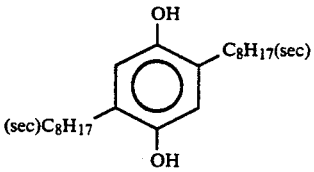
Cpd-A
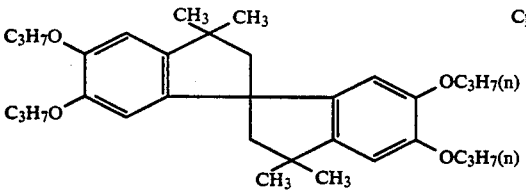
Cpd-B
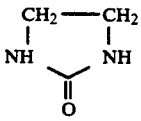
Cpd-C
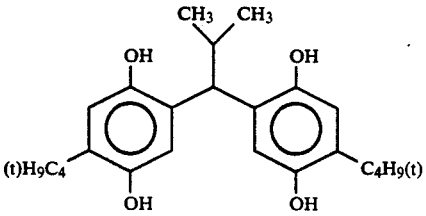
Cpd-D
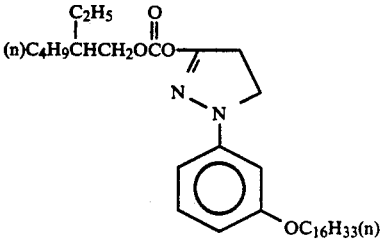
Cpd-E -continued
Cpd-F
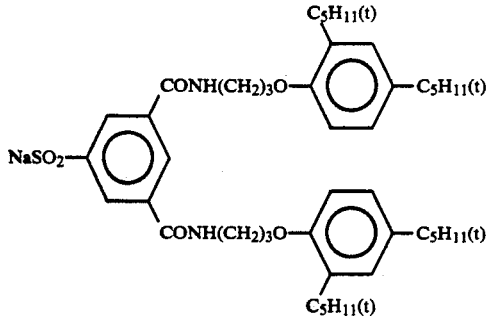
Cpd-G
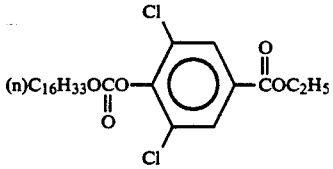
Cpd-H
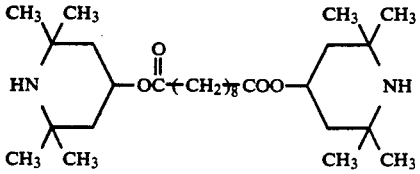
Cpd-I
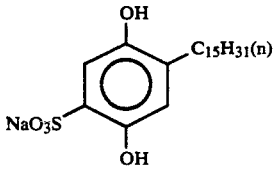
Cpd-J
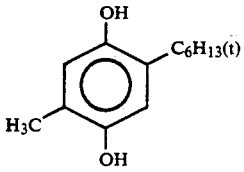
Cpd-K
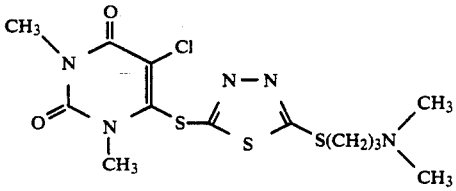
Cpd-L
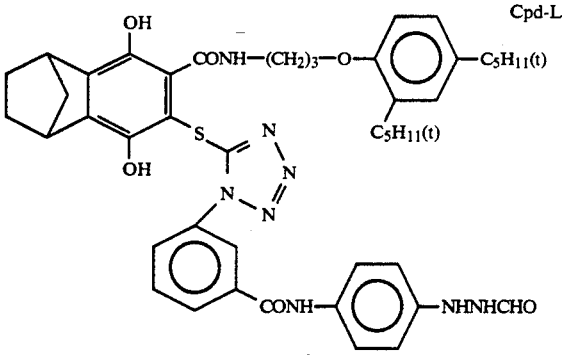
Cpd-M
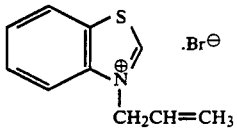
Cpd-O
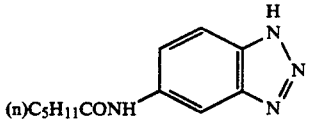
Cpd-P
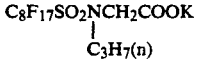
Cpd-Q
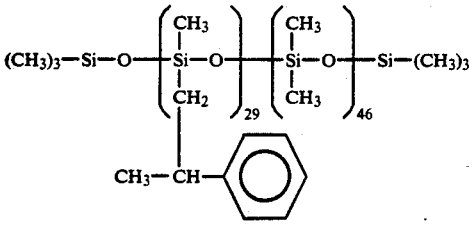
Cpd-R
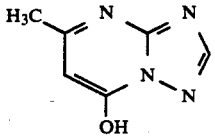
Cpd-S
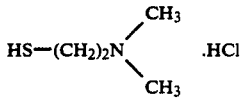
Cpd-T
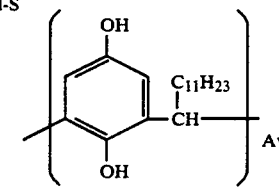
Average Molecular Weight: 10,000

-continued
U-1
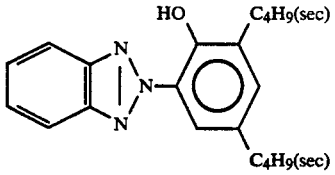
U-2
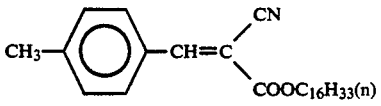
U-3
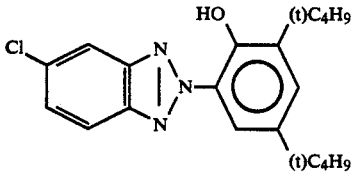
U-4
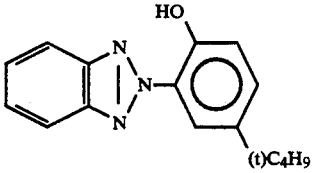
U-5
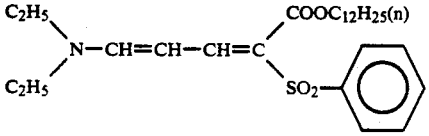
U-6
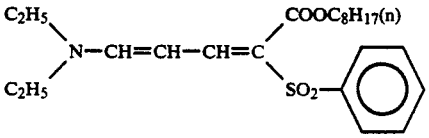
S-1
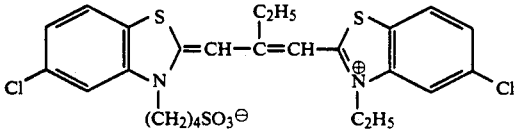
S-2
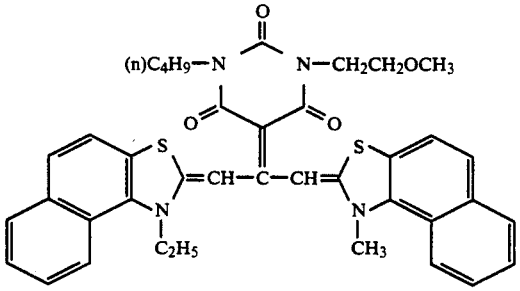
S-3
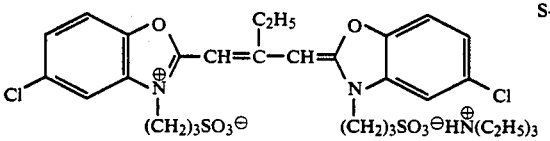
S-4
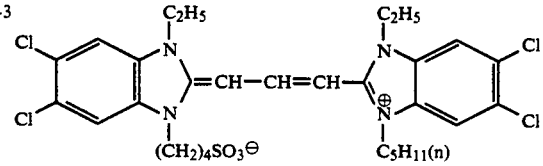
S-5
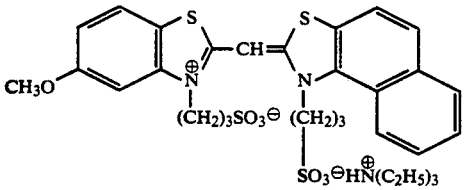
S-6
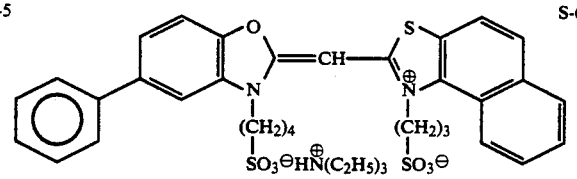
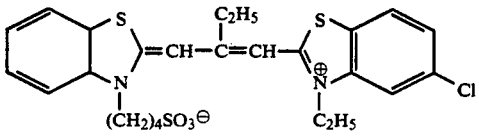
S-7
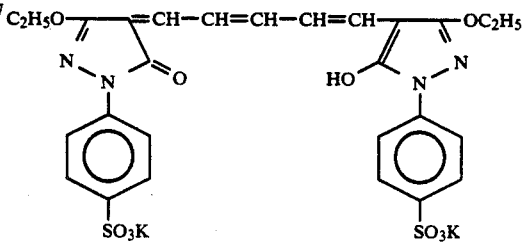
D-1

-continued

D-2

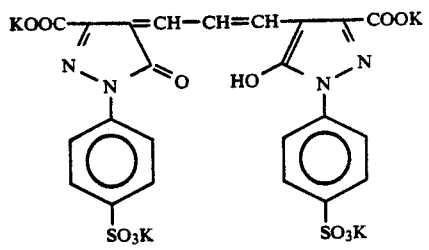

D-3

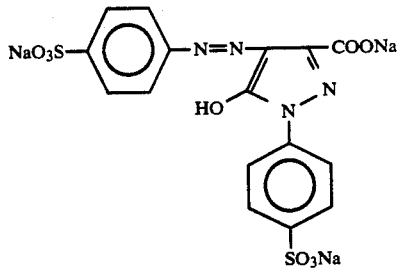

D-4

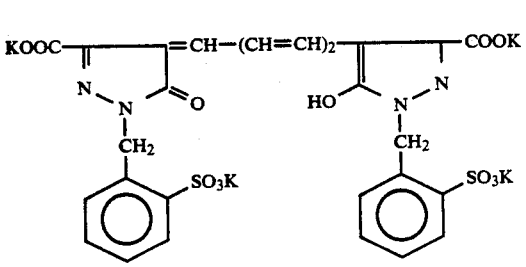

D-5

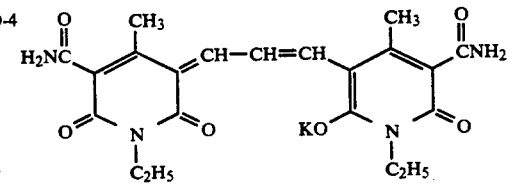

D-6

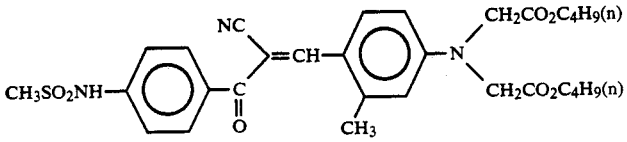

H-1

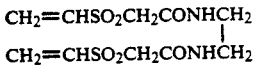

SA-1

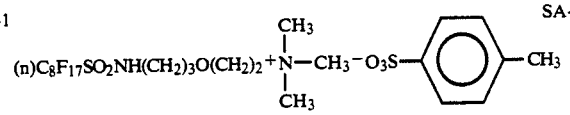

SA-2

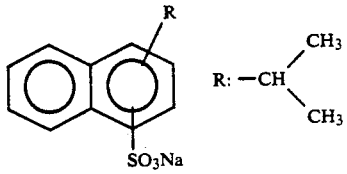

SA-3

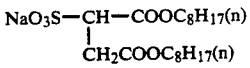

SA-4

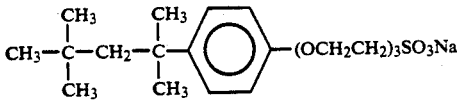

SA-5

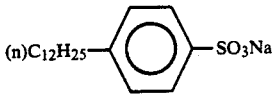

Preparation of Sample 102

Sample 102 was prepared in the same manner as for Sample 101, except for changing the silver iodide content of the light-sensitive silver halide emulsion of the 4th, 5th, 6th, 9th, 10th, 11th, 15th, 16th, and 17th layers to 7.0 mol %, 6 mol %, 5 mol %, 6.5 mol %, 5.5 mol %, 5.0 mol %, 5 mol %, 6 mol %, and 6.5 mol %, respectively. The average silver iodide content .of the total light-sensitive silver halide emulsions was 5.8 mol %.

Preparation of Sample 103

Sample 103 was prepared in the same manner as for Sample 101, except for changing the silver iodide content of the light-sensitive silver halide emulsion of the 4th, 5th, 6th, 9th, 10th, 11th, 15th, 16th, and 17th layers to 4.5 mol %, 3.5 mol %, 3 mol %, 5 mol %, 4.4 mol %, 3.8 mol %, 3 mol %, 4 mol %, and 6 mol %, respectively. The average silver iodide content of the total light-sensitive silver halide emulsions was 4.1 mol %.

Preparation of Samples 104 to 106

Samples 104 to 106 were prepared in the same manner as for Samples 101 to 103, respectively, except that the light-sensitive silver halide emulsion layers and/or adjacent light-insensitive hydrophilic colloidal layers shown in Table 1 below further contained the compound and/or emulsion shown.

Preparation of Samples 107 to 117

Samples 107 to 117 were prepared in the same manner as for Sample 103, except that the layers shown in Table 1 further contained the compound and/or emulsion shown.

The amount of Emulsion A or B used in the above samples was 0.1 g-Ag/m$^2$/layer. The amounts of other additives per layer are shown in Table 1.

The interimage effects exercised on the red-sensitive emulsion layers and green-sensitive emulsion layers in Samples 101 to 117 were determined by the above-described method, and the results obtained are shown in Table 2 below. In the determination, development processing was carried out according to the procedures described below.

Each of Samples 101 to 117 was cut to films having a size of 4×5 in. The following objects were prepared.

Bright red and green balls were arranged in a row, and each row of red and green balls was lightened from one end to create bright red and shaded red and bright green and shaded green. Further, bright red roses and a bright green foliage plant were lightened to make a shadow.

A photograph was taken of these objects using Samples 101 to 117, and Samples were subjected to the following developing process. Samples developed were evaluated by visually judging saturation and the shade of the resulting image, and the results obtained are shown in Table 2.

Processing Procedure

| Step | Time (min) | Temp. (°C.) | Tank Volume (l) | Rate of Replenishment (ml/m²) |
|---|---|---|---|---|
| B/W development | 6 | 38 | 12 | 2.2 |
| 1st Washing | 2 | 38 | 4 | 7.5 |
| Reversing | 2 | 38 | 4 | 1.1 |
| Color development | 6 | 38 | 12 | 2.2 |
| Conditioning | 2 | 38 | 4 | 1.1 |
| Bleach | 6 | 38 | 12 | 0.22 |
| Fixing | 4 | 38 | 8 | 1.1 (l/m²) |
| 2nd Washing | 4 | 38 | 8 | 7.5 |
| Stabilization | 1 | 25 | 2 | 1.1 |

Processing solutions used has the following compositions.

B/W Developing Solution

| | Mother Solution | Replenisher |
|---|---|---|
| Pentasodium nitrilo-N,N,N-trimethylenephosphonate | 2.0 g | 2.0 g |
| Sodium sulfite | 30 g | 30 g |
| Potassium hydroquinone-monosulfonate | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1000 ml | 1000 ml |
| pH (adjusted with hydrochloric acid or potassium hydroxide) | 9.60 | 9.60 |

Reversing Solution

The mother solution and the replenisher has the same composition.

| | |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1000 ml |
| pH (adjusted with hydrochloric acid | 6.00 |

-continued

| | |
|---|---|
| or sodium hydroxide) | |

Color Developing Solution

| | Mother Solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-(β-methanesulfonamidoethyl)-3-methyl-4-aminoaniline sulfate | 11 g | 11 g |
| 3,6-Dithia-1,8-octanediol | 1.0 g | 1.0 g |
| Water to make | 1000 ml | 1000 ml |
| pH (adjusted with hydrochloric acid or potassium hydroxide) | 11.80 | 12.00 |

Conditioning Solution

The mother solution and the replenisher has the same composition.

| | |
|---|---|
| Disodium ethylenediaminetetraacetate dihydrate | 8.0 g |
| Sodium sulfite | 12 g |
| 1-Thioglycerin | 0.4 ml |
| Sorbitan ester | 0.1 g |

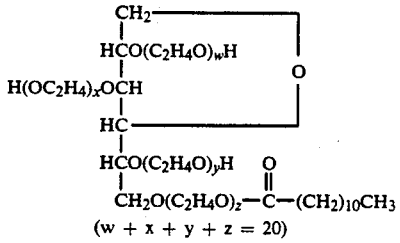

| | |
|---|---|
| Water to make | 1000 ml |
| pH (adjusted with hydrochloric acid or sodium hydroxide) | 6.20 |

Bleaching Solution

| | Mother Solution | Replenisher |
|---|---|---|
| Disodium ethylenediaminetetraacetate dihydrate | 2.0 g | 4.0 g |
| Ammonium (ethylenediaminetetraacetato)iron (III) dihydrate | 120 g | 240 g |
| Potassium bromide | 100 g | 200 g |
| Ammonium nitrate | 10 g | 20 g |
| Water to make | 1000 ml | 1000 ml |
| pH (adjusted with hydrochloric acid or sodium hydroxide) | 5.70 | 5.50 |

Fixing Solution

The mother solution and the replenisher had the same composition.

| | |
|---|---|
| Ammonium thiosulfate | 8.0 g |
| Sodium sulfite | 5.0 g |
| Sodium bisulfite | 5.0 g |
| Water to make | 1000 ml |
| pH (adjusted with hydrochloric acid or aqueous ammonia) | 6.60 |

Stabilizing Bath

The mother solution and the replenisher had the same composition.

| | |
|---|---|
| Formalin (37%) | 5.0 ml |
| Polyoxyethylene-p-monononylphenyl ether (average degree of polymerization: 10) | 0.5 ml |
| Water to make | 1000 ml |
| pH | not adjusted |

TABLE 1

| Sample No. | Average AgI Content (mol %) | Additive | Inter-image Effect-Producing Means | Remark |
|---|---|---|---|---|
| 101 | 4.0 | — | — | Comparison |
| 102 | 5.8 | — | (1) | Comparison |
| 103 | 4.1 | — | (1) | Comparison |
| 104 | 4.0 | Emulsion A to 3rd and 8th layers; Emulsion B to 4th, 9th and 14th layers; Compound III-10 (0.01 g/m²/layer) to 4th, 9th and 15th layers | (3), (5), (6) | Comparison |
| 105 | 5.8 | Emulsion A to 3rd and 8th layers; Emulsion B to 4th, 9th and 14th layers; Compound III-10 (0.01 g/m²/layer) to 4th, 9th and 15th layers | (1), (3), (5), (6) | Comparison |
| 106 | 4.1 | Emulsion A to 3rd and 8th layers; Emulsion B to 4th, 9th and 14th layers; Compound III-10 (0.01 g/m²/layer) to 4th, 9th and 15th layers | (1), (3), (5), (6) | Invention |
| 107 | 4.1 | Emulsion A to 3rd , 8th and 14th layers; Emulsion B to 4th and 9th layers | (1), (5), (6) | " |
| 108 | 4.1 | II-2 (0.1 g/m²/layer) to 3rd, 4th, 8th, 9th and 15th layers | (1), (2) | " |
| 109 | 4.1 | III-4 (0.03 g/m²/layer) to 4th, 9th and 15th layers; III-9 (0.01 g/m²/layer) to 5th and 10th layers | (1), (3) | " |
| 110 | 4.1 | yellow colloidal silver (5 mg/m²/layer) to 3rd and 8th layers; III-1 (0.03 g/m²/layer) to 4th, 9th and 14th layers | (1), (3), (7) | " |
| 111 | 4.1 | II-10 (0.05 g/m²) to 3rd layer; Emulsion A to 8th and 15th layers; III-4 (0.02 g/m²/layer) to 4th, 9th and 10th layers; III-9 (0.01 g/m²/layer) to 6th, 11th and 17th layers | (1), (2), (3), (5) | Invention |
| 112 | 4.1 | Emulsion A to 4th, 9th and 15th layers | (1), (5) | " |
| 113 | 4.1 | Emulsion B to 4th, 9th and 15th layers; III-11 (0.02 g/m²/layer) to 4th, 9th and 15th layers | (1), (3), (6) | " |
| 114 | 4.1 | III-12 (0.02 g/m²/layer) to 4th, 9th and 15th layers; cyan coupler C-12 (0.08 g/m²/layer) to 3rd and 4th layers | (1), (3), (8) | " |
| 115 | 4.1 | Emulsion B to 4th and 8th layers; III-1 (0.02 g/m²/layer) to 4th layer; Emulsion A to 3rd layer | (1), (3), (5), (6) | " |
| 116 | 4.1 | Emulsion A to 4th, 5th, 9th, 10th and 11th layers; III-1 (0.02 g/m²/layer) to 4th, 5th, 6th, 9th and 10th layers | (1), (3), (5) | Comparison |
| 117 | 4.1 | Emulsion A to 3rd, 4th, 8th and 9th layers; IV-10 (0.05 g/m²/layer) to 4th and 9th layers; III-5 (0.02 g/m²/layer) to 4th and 9th layers; cyan coupler C-12 (0.08 g/m²/layer) to 4th layer | (1), (2), (3), (5), (8) | Comparison |

TABLE 2

| Sample No. | $\Delta\log E(R_{0.5})$ | $\Delta\log E(R_{1.5})$ | $\Delta\log E(R_{0.5}) - \Delta\log E(R_{1.5})$ | $\Delta\log E(G_{0.5})$ | $\Delta\log E(G_{1.5})$ | $\Delta\log E(G_{0.5}) - \Delta\log E(G_{1.5})$ | Red Color Reproducibility | | Green Color Reproducibility | |
|---|---|---|---|---|---|---|---|---|---|---|
| | | | | | | | Saturation | Description of Shade | Saturation | Description of Shade |
| 101 | 0.12 | 0.01 | 0.11 | 0.17 | 0.03 | 0.14 | Low | Bad | Low | Bad |
| 102 | 0.04 | 0.01 | 0.03 | 0.08 | 0.01 | 0.07 | Low | Bad | Low | Bad |
| 103 | 0.17 | 0.02 | 0.15 | 0.21 | 0.04 | 0.17 | Low | Good | Low | Good |
| 104 | 0.18 | 0.05 | 0.13 | 0.22 | 0.05 | 0.17 | Low | Good | Low | Good |
| 105 | 0.06 | 0.01 | 0.05 | 0.11 | 0.02 | 0.09 | Low | Bad | Low | Bad |
| 106 | 0.37 | 0.05 | 0.32 | 0.41 | 0.09 | 0.32 | Very high | Good | Very high | Good |
| 107 | 0.31 | 0.03 | 0.28 | 0.36 | 0.04 | 0.32 | High | Good | High | Good |
| 108 | 0.24 | 0.02 | 0.22 | 0.27 | 0.03 | 0.24 | High | Good | High | Good |
| 109 | 0.25 | 0.03 | 0.22 | 0.29 | 0.04 | 0.25 | High | Good | High | Good |
| 110 | 0.27 | 0.02 | 0.25 | 0.31 | 0.03 | 0.28 | High | Good | High | Good |
| 111 | 0.36 | 0.06 | 0.30 | 0.40 | 0.13 | 0.27 | Very High | Good | Very High | Good |
| 112 | 0.28 | 0.05 | 0.23 | 0.30 | 0.05 | 0.25 | High | Good | High | Good |
| 113 | 0.33 | 0.05 | 0.28 | 0.37 | 0.08 | 0.29 | High | Good | High | Good |
| 114 | 0.32 | 0.04 | 0.28 | 0.24 | 0.02 | 0.22 | High | Good | Low | Good |
| 115 | 0.37 | 0.05 | 0.32 | 0.28 | 0.04 | 0.24 | Very High | Good | High | Good |
| 116 | 0.34 | 0.21 | 0.13 | 0.37 | 0.19 | 0.18 | High | Bad | High | Bad |

TABLE 2-continued

| Sample No. | $\Delta\log E(R_{0.5})$ | $\Delta\log E(R_{1.5})$ | $\Delta\log E(R_{0.5}) - \Delta\log E(R_{1.5})$ | $\Delta\log E(G_{0.5})$ | $\Delta\log E(G_{1.5})$ | $\Delta\log E(G_{0.5}) - \Delta\log E(G_{1.5})$ | Red Color Reproducibility | | Green Color Reproducibility | |
|---|---|---|---|---|---|---|---|---|---|---|
| | | | | | | | Saturation | Description of Shade | Saturation | Description of Shade |
| 117 | 0.41 | 0.04 | 0.37 | 0.45 | 0.08 | 0.37 | Very High | Bad | Very High | Bad |

Cyan Coupler (C-12):

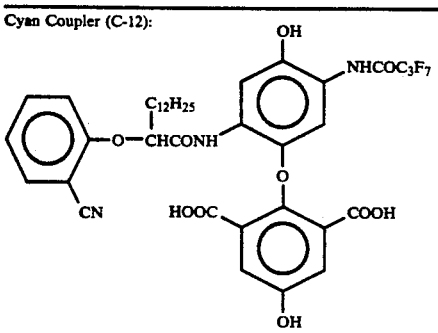

The results of Table 2 prove the followings:

1) Even with interimage effect-producing means (1) being provided, the interimage effect produced does not satisfy relationships (a) or (b) unless at least one of means (2) to (8) is used (compare Sample 101 with Samples 102 and 103).

2) Even with at least one of interimage effect-producing means (2) to (8) being provided, the interimage effect produced does not satisfy relationships (a) or (b) unless means (1) is provided, or unless the total light-sensitive silver halide emulsion has an average silver iodide content of not more than 5.5 mol % (Samples 104 and 105).

3) If $\Delta\log E(R_{0.5})$ or $\Delta\log E(G_{0.5})$ is smaller than the respective range as specified in relationships (a) or (b), saturation of a color image becomes low (Samples 101 to 105).

4) If $\Delta\log E(R_{0.5})$ or $\Delta\log E(G_{0.5})$ is smaller than the respective range as specified in relationships (a) or (b) and, also, if $(\Delta\log E(R_{0.5})-\Delta\log E(R_{1.5}))$ or $(\Delta\log E(G_{0.5})-\Delta\log E(G_{1.5}))$ is smaller than the respective range as specified by relationships (a) or (b), a color image has reduced saturation and a poor description of the shade (Samples 101 to 102 and 105).

5) Even with interimage effect-producing means (1) and at least one of means (2) to (8) being provided, an excessive interimage effect exercised on the high density area causes $\Delta\log E(R_{1.5})$ or $\Delta\log E(G_{1.5})$ to exceed the respective range as specified by relationships (a) or (b) and $(\Delta\log E(R_{0.5})-\Delta\log E(R_{1.5}))$ or $(\Delta\log E(G_{0.5})-\Delta\log E(G_{1.5}))$ to become smaller than the respective range as specified by relationships (a) or (b). As a result, high saturation can be obtained, but a description of the shade is deteriorated (Sample 116).

6) Even with interimage effect-producing means (1) and at least one of means (2) to (8) being provided, an excessive interimage effect exercised on the low density area causes $\Delta\log E(R_{0.5})$ or $\Delta\log E(G_{0.5})$ to exceed the respective range as specified by relationships (a) or (b) and $(\Delta\log E(R_{0.5})-\Delta\log E(R_{1.5}))$ or $(\Delta\log E(G_{0.5})-\Delta\log E(G_{1.5}))$ to become greater than the respective range as specified by relationships (a) or (b). As a result, high saturation can be obtained, but a description of the shade is deteriorated (Sample 117).

7) When interimage effect-producing means (1) and at least one of means (2) to (8) are provided to produce a proper interimage effect, the interimage effect produced be able to be fallen within the range specified by relationships (a) or (b). With these conditions being fulfilled, both high saturation and a satisfactory description of the shade can be obtained (Samples 106 to 115).

EXAMPLE 2

Samples in Example 1 were subjected to the development processing in the same manner as in Example 1 except the compositions of conditioning Solution and Stabilizing Solution used in Example 1 were replaced with the following Compositions. Results the same as in Example 1 were obtained.

Conditioning Solution

The mother solution and the replenisher had the same composition.

| | |
|---|---|
| Disodium ethylenediaminetetraacetate dihydrate | 8.0 g |
| Sodium sulfite | 12 g |
| 1-Thioglycerin | 0.4 ml |
| Sorbitan ester | 0.1 g |
| Hexamethylenetetramine | 7.0 g |
| Water to make | 100 ml |
| pH (adjusted with hydrochloric acid or sodium hydroxide) | 6.2 |

Stabilizing Bath

The mother solution and the replenisher had the same composition.

| | |
|---|---|
| Polyoxyethylene-p-monononylphenyl ether (average degree of polymerization: 10) | 0.5 ml |
| Water to make | 1000 ml |
| pH | not adjusted |

As described and demonstrated above, the silver halide color reversal photographic material according to the present invention has high saturation and excellent description of a shade and is thus advantageous for practical use.

While the invention has been described in detail and with reference to specific examples thereof, it will be apparent to one skilled in the art that various changes and modifications can be made therein without departing from the spirit and scope thereof.

What is claimed is:

1. A silver halide color reversal photographic material comprising a support having thereon light-sensitive silver halide layers comprising:

(A) at least one cyan coupler-containing red-sensitive silver halide emulsion layer, (B) at least one magenta coupler-containing green-sensitive silver halide emulsion layer, and (C) at least one yellow coupler-containing blue-sensitive silver halide emulsion layer, wherein the total light-sensitive silver halide grains in the photographic material have an average silver iodide content of 5.5 mol % or less, and wherein (i) at least one of the red, green, and blue light-sensitive silver halide emulsion layers, (ii) a substantially light-insensitive hydrophilic colloidal layer adjacent thereto, or (iii) both (i) and (ii)

comprise(s) a means for producing an interimage effect, said interimage effect satisfying at least one of relationships (a) and (b):

(a)

$$0.20 \leqq \Delta\log E(R_{0.5}) \leqq 0.40,$$

$$0 \leqq \Delta\log E(R_{1.5}) \leqq 0.07,$$

and $$0.18 \leqq \Delta\log E(R_{0.5}) - \Delta\log E(R_{1.5}) \leqq 0.35$$

(b)

$$0.25 \leqq \Delta\log E(G_{0.5}) \leqq 0.45,$$

$$0 \leqq \Delta\log E(G_{1.5}) \leqq 0.15,$$

and $$0.23 \leqq \Delta\log E(G_{0.5}) - \Delta\log E(G_{1.5}) \leqq 0.35$$

wherein $\Delta\log E(R_{0.5})$ and $\Delta\log E(R_{1.5})$ each represents an interimage effect on a red-sensitive silver halide emulsion layer at a cyan density of 0.5 and 1.5, respectively; and $\Delta\log E(G_{0.5})$ and $\Delta\log E(G_{1.5})$ each represents an interimage effect on a green-sensitive silver halide emulsion layer at a magenta density of 0.5 and 1.5, respectively.

2. A silver halide color reversal photographic material as claimed in claim 1, wherein said means for producing an interimage effect comprises at least one of:

(1) at least one pair of the red, green, and blue light-sensitive silver halide emulsion layers, which differ in color sensitivity, differ in average silver iodide content by at least 1 mol %;

(2)

(i) at least one of the red, green, and blue light-sensitive silver halide emulsion layers, (ii) a substantially light-insensitive hydrophilic colloidal layer adjacent thereto, or (iii) both (i) and (ii)

contain(s) a compound capable of releasing a development inhibitor or a precursor thereof on oxidation-reduction reaction with an oxidation product of a developing agent;

(3)

(i) at least one of the red, green, and blue light-sensitive silver halide emulsion layers, (ii) a substantially light-insensitive hydrophilic colloidal layer adjacent thereto, or (iii) both (i) and (ii)

contain(s) a compound represented by formula (III):

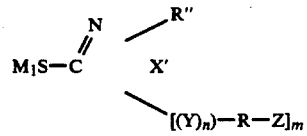

(III)

wherein $M_1$ represents a hydrogen atom, a cation, or a mercapto-protecting group which is split off with an alkali; X' represents an atomic group necessary to form a 5- or 6-membered heterocyclic ring containing at least one of a sulfur atom, a selenium atom, a nitrogen atom, and an oxygen atom as a hetero atom which may be substituted or may be condensed; R represents a straight chain or branched alkylene group, a straight chain or branched alkenylene group, a straight chain or branched aralkylene group, or an arylene group; Z represents a polar substituent; Y represents

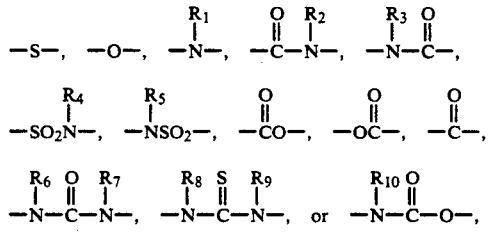

wherein $R_1$, $R_2$, $R_3$, $R_4$, $R_5$, $R_6$, $R_7$, $R_8$, $R_9$, and $R_{10}$, which may be the same or different, each represents a hydrogen atom, a substituted or unsubstituted alkyl group, a substituted or unsubstituted aryl group, a substituted or unsubstituted alkenyl group, or a substituted or unsubstituted aralkyl group; R'' represents a hydrogen atom or a group capable of substituting for a hydrogen atom; n represents 0 or 1; and m represents 0, 1, or 2;

(4)

(i) at least one of the red, green, and blue light-sensitive silver halide emulsion layers, (ii) a substantially light-insensitive hydrophilic colloidal layer adjacent thereto, or (iii) both (i) and (ii)

contains at least one of a diffusible 4-thiazolin-2-thion compound or an N-substituted-4-thiazolin-2-thion compound;

(5)

(i) at least one of the red, green, and blue light-sensitive silver halide emulsion layers, (ii) a substantially light-insensitive hydrophilic colloidal layer adjacent thereto, or (iii) both (i) and (ii)

contain(s) a silver halide emulsion comprising surface-fogged silver halide grains;

(6)

(i) at least one or the red, green, and blue light-sensitive silver halide emulsion layers, (ii) a substantially light-insensitive hydrophilic colloidal layer adjacent thereto, or
(iii) both (i) and (ii)
contain(s) a silver halide emulsion comprising internally-fogged silver halide grains;

(7)
(i) at least one of the red, green, and blue light-sensitive silver halide emulsion layers,
(ii) a substantially light-insensitive hydrophilic colloidal layer adjacent thereto, or
(iii) both (i) and (ii)
contain(s) colloidal silver in a layer other than a yellow filter layer or an antihalation layer; and (8)
(i) at least one of the red, green, and blue light-sensitive silver halide emulsion layers,
(ii) a substantially light-insensitive hydrophilic colloidal layer adjacent thereto, or
(iii) both (i) and (ii)
contain(s) an electron donor-releasing coupler.

3. A silver halide color reversal photographic material as claimed in claim 2, wherein said means is a combination of means (1) and at least one of means (2) to (8).

4. A silver halide color reversal photographic material as claimed in claim 2, wherein said means is a combination of means (1) and at least one of means (2), (3), (5), and (6).

5. A silver halide color reversal photographic material as claimed in claim 2, wherein said compound capable of releasing a development inhibitor or a precursor thereof an oxidation-reduction reaction with an oxidation product of a developing agent is a compound selected from the group consisting of compounds represented by formula (II) or (IV):

$$A-(Time)_t-X \qquad (II)$$

wherein A represents an oxidation-reduction nucleus which allows $-(Time)_tX$ to be released therefrom upon being oxidized during development processing; Time represents a timing group linked to A through a sulfur atom, a nitrogen atom or an oxygen atom; t represents 0 or 1; and X represents a development inhibitor moiety;

$$R_1-\underset{\underset{A_1}{|}}{N}-\underset{\underset{A_2}{|}}{N}-G_1-(Time)_t-PUG \qquad (IV)$$

wherein $R_1$ represents an aliphatic or aromatic group; $G_1$ represents $$-\overset{O}{\overset{\|}{C}}-,\ -SO_2-,\ -SO-,\ -\overset{O}{\overset{\|}{\underset{\underset{R_2}{|}}{P}}}-,$$

or an iminomethylene group; $R_2$ represents an alkoxy group, an aryloxy group, or an amino group; $A_1$ and $A_2$ both represent a hydrogen atom, or one of them represents a hydrogen atom with the other representing a substituted or unsubstituted alkyl sulfonyl group, a substituted or unsubstituted arylsulfonyl group, or a substituted or unsubstituted acyl group; Time represents a divalent linking group; t represents 0 or 1; and PUG represents a development inhibitor moiety.

6. A silver halide color reversal photographic material as claimed in claim 2, wherein at least one of said red-sensitive emulsion layer and said green-sensitive emulsion layer comprises two or more layers having different sensitivity, and a lower sensitivity layer in said two or more layers has a higher silver iodide content than a higher sensitivity layer in said two or more layers.

7. A silver halide color reversal photographic material as claimed in claim 6, wherein a cyan coupler is incorporated into at least one of the green-sensitive layer having the highest sensitivity, a substantially light-insensitive hydrophilic colloidal layer adjacent to the highest sensitivity green-sensitive layer, the blue-sensitive layer having the highest sensitivity, and a substantially light-insensitive hydrophilic colloidal layer adjacent to the highest sensitivity blue-sensitive layer.

8. A silver halide color reversal photographic material as claimed in claim 2, wherein at least one of said red-sensitive emulsion layer and said green-sensitive emulsion layer comprises two or more layers having different sensitivity, and at least one of the lowest sensitivity layer in said two or more layers and a substantially light-sensitive hydrophilic colloidal layer(s) adjacent thereto being provided with said means (1) and at least one of said means (2), (3), (5), and (6).

9. A silver halide color reversal photographic material as claimed in claim 8, wherein a cyan coupler is incorporated into at least one of the green-sensitive layer having the highest sensitivity, a substantially light-insensitive hydrophilic colloidal layer adjacent to the highest sensitivity green-sensitive layer, the blue-sensitive layer having the highest sensitivity, and a substantially light-insensitive hydrophilic colloidal layer adjacent to the highest sensitivity blue-sensitive layer.

10. A silver halide color reversal photographic material as claimed in claim 9, wherein a magenta coupler is incorporated into at least one of the red-sensitive layer having the highest sensitivity, a substantially light-insensitive hydrophilic colloidal layer adjacent to the highest sensitivity red-sensitive layer, the blue-sensitive layer having the highest sensitivity, and a substantially light-insensitive hydrophilic colloidal layer adjacent to the highest sensitivity blue-sensitive layer.

11. A silver halide color reversal photographic material as claimed in claim 8, wherein a magenta coupler is incorporated into at least one of the red-sensitive layer having the highest sensitivity, a substantially light-insensitive hydrophilic colloidal layer adjacent to the highest sensitivity red-sensitive layer, the blue-sensitive layer having the highest sensitivity, and a substantially light-insensitive hydrophilic colloidal layer adjacent to the highest sensitivity blue-sensitive layer.

12. A silver halide color reversal photographic material as claimed in claim 2, wherein, in any of means (2) to (8), both the at least one of the red, green, and blue light-sensitive silver halide emulsion layers and the substantially light-insensitive hydrophilic colloidal layer adjacent thereto contain the means for producing an interimage effect.

13. A silver halide color reversal photographic material as claimed in claim 1, wherein the total light-sensitive silver halide grains in the photographic material have an average silver iodide content of 5.2 mol % or less.

14. A silver halide color reversal photographic material as claimed in claim 1, wherein the total light-sensitive silver halide grains in the photographic material have an average silver iodide content of from 5.0 to 1.7 mol %.

15. A silver halide color reversal photographic material as claimed in claim 1, wherein the interimage effect exercised on a red-sensitive silver halide emulsion layer satisfies relationship (a'):

(a')

$$0.20 \leqq \Delta\log E(R_{0.5}) \leqq 0.38,$$

$$0.02 \leqq \Delta\log E(R_{1.5}) \leqq 0.07,$$

and $$0.19 \leqq \Delta\log E(R_{0.5}) - \Delta\log E(R_{1.5}) \leqq 0.34.$$

16. A silver halide color reversal photographic material as claimed in claim 1, wherein the interimage effect on a green-sensitive emulsion layer satisfies the relationship (b'):

(b')

$$0.26 \leqq \Delta\log E(G_{0.5}) \leqq 0.44,$$

$$0.02 \leqq \Delta\log E(G_{1.5}) \leqq 0.15,$$

and $$0.24 \leqq \Delta\log E(G_{0.5}) - \Delta\log E(G_{1.5}) \leqq 0.34.$$

17. A silver halide color reversal photographic material as claimed in claim 1, wherein silver halide of at least one of said silver halide emulsion layers comprises silver iodobromide, silver iodochloride or silver iodochlorobromide each containing not more than 10 mol % of silver iodide.

18. A silver halide color reversal photographic material as claimed in claim 1, wherein the total silver coverage of the photographic material is not more than 6.0 $g/m^2$.

* * * * *